US010809009B2

(12) United States Patent
Schouten et al.

(10) Patent No.: US 10,809,009 B2
(45) Date of Patent: Oct. 20, 2020

(54) HEAT EXCHANGER HAVING AERODYNAMIC FEATURES TO IMPROVE PERFORMANCE

(71) Applicant: Dana Canada Corporation, Oakville (CA)

(72) Inventors: Eric J. Schouten, Hamilton (CA); Cameron L. M. Stevens, Oakville (CA); Benjamin A. Kenney, Toronto (CA); Lee M. Kinder, Oakville (CA)

(73) Assignee: Dana Canada Corporation, Oakville, Ontario (CA)

( * ) Notice: Subject to any disclaimer, the term of this patent is extended or adjusted under 35 U.S.C. 154(b) by 164 days.

(21) Appl. No.: 15/783,561

(22) Filed: Oct. 13, 2017

(65) Prior Publication Data

US 2018/0292142 A1 Oct. 11, 2018

Related U.S. Application Data

(60) Provisional application No. 62/408,216, filed on Oct. 14, 2016, provisional application No. 62/537,772, filed on Jul. 27, 2017.

(51) Int. Cl.
*F28D 9/00* (2006.01)
*F28F 9/00* (2006.01)
(Continued)

(52) U.S. Cl.
CPC ..... *F28D 9/0056* (2013.01); *F28D 9/0006* (2013.01); *F28D 9/0043* (2013.01);
(Continued)

(58) Field of Classification Search
CPC .... F28D 9/0056; F28D 9/0006; F28D 9/0043; F28D 9/005; F28F 9/001; F28F 9/22; F28F 2230/00; F02B 29/0418
(Continued)

(56) References Cited

U.S. PATENT DOCUMENTS 3,460,611 A * 8/1969 Tramuta ..... F28D 9/0037 165/166
4,270,602 A 6/1981 Foster
(Continued)

FOREIGN PATENT DOCUMENTS

CA 2857079 A1 6/2013
DE 4020754 A1 1/1992
(Continued)

OTHER PUBLICATIONS

Machine-Generated English Translation of DE 4020754, obtained via Espacenet Patent Search.
(Continued)

*Primary Examiner* — Tho V Duong
(74) *Attorney, Agent, or Firm* — Ridout & Maybee LLP

(57) ABSTRACT

A gas-liquid heat exchanger such as a charge air cooler has a core comprising a stack of flat tubes defining liquid coolant flow passages, and a plurality of open-ended gas flow passages between the flat tubes. An endmost gas flow passage is defined between an end plate of the core and an adjacent flat tube, such that the endmost gas flow passage is in contact with only said adjacent one of said flat tubes. A blocking element extends along either the front face or the rear face of the core and at least partly blocking the endmost gas flow passage. Each flat tube may comprise a pair of core plates, at least one including a flap projecting into a gas flow passage and covering a gas bypass channel between the edge of the turbulence-enhancing insert and the sides of a coolant manifold.

8 Claims, 31 Drawing Sheets

(51) Int. Cl.

| | |
|---|---|
| ***F28F 9/007*** | (2006.01) |
| ***F28F 9/22*** | (2006.01) |
| ***F28F 13/06*** | (2006.01) |
| ***F28F 13/12*** | (2006.01) |
| *F28D 21/00* | (2006.01) |

(52) U.S. Cl.
CPC ..... *F28F 9/001* (2013.01); *F28F 9/005* (2013.01); *F28F 9/0075* (2013.01); *F28F 9/22* (2013.01); *F28F 13/06* (2013.01); *F28F 13/12* (2013.01); *F28D 2021/0082* (2013.01); *F28F 2230/00* (2013.01); *F28F 2250/06* (2013.01)

(58) Field of Classification Search
USPC ..... 165/166
See application file for complete search history.

(56) References Cited

U.S. PATENT DOCUMENTS

| | | | | |
|---|---|---|---|---|
| 4,378,174 | A | 3/1983 | Hesse | |
| 5,029,639 | A | 7/1991 | Finnemore et al. | |
| 5,056,590 | A | 10/1991 | Bohn | |
| 5,123,482 | A | 6/1992 | Abraham | |
| 5,291,945 | A | 3/1994 | Blomgren et al. | |
| 5,785,117 | A | 7/1998 | Grinbergs | |
| RE35,890 | E | 9/1998 | So | |
| 5,931,219 | A * | 8/1999 | Kull | F28D 9/005 165/166 |
| 6,132,689 | A * | 10/2000 | Skala | B01J 15/005 165/166 |
| 6,199,626 | B1 | 3/2001 | Wu et al. | |
| 6,273,183 | B1 | 8/2001 | So et al. | |
| 6,973,961 | B2 | 12/2005 | Rehberg et al. | |
| 7,036,562 | B2 | 5/2006 | Ayres et al. | |
| 7,077,192 | B2 | 7/2006 | Avequin et al. | |
| 7,219,720 | B2 * | 5/2007 | Wakita | B23P 15/26 165/153 |
| 7,341,098 | B2 | 3/2008 | Brost et al. | |
| 7,404,434 | B2 | 7/2008 | Martin et al. | |
| 7,478,630 | B2 | 1/2009 | Maucher et al. | |
| 7,571,718 | B2 | 8/2009 | Hendrix et al. | |
| 7,610,949 | B2 * | 11/2009 | Palanchon | F28D 9/0043 165/103 |
| 7,681,629 | B2 * | 3/2010 | Yamaguchi | F01N 5/02 165/166 |
| 7,854,255 | B2 | 12/2010 | Nakamura | |
| 8,286,615 | B2 | 10/2012 | Dehnen et al. | |
| 8,316,925 | B2 | 11/2012 | Pimentel et al. | |
| 9,038,610 | B2 | 5/2015 | Meshenky et al. | |
| 9,541,334 | B2 | 1/2017 | Von Eckermann et al. | |
| 9,631,876 | B2 | 4/2017 | Zima et al. | |
| 9,903,661 | B2 | 2/2018 | Odillard et al. | |
| 2005/0284620 | A1 * | 12/2005 | Thunwall | F28D 9/0043 165/167 |
| 2007/0181294 | A1 * | 8/2007 | Soldner | F28D 9/0031 165/175 |
| 2008/0110595 | A1 | 5/2008 | Palanchon | |
| 2008/0202735 | A1 | 8/2008 | Geskes et al. | |
| 2013/0025835 | A1 * | 1/2013 | Von Eckermann | F28D 9/0043 165/157 |
| 2013/0133866 | A1 | 5/2013 | Kinder et al. | |
| 2014/0060789 | A1 | 3/2014 | Rousseau | |
| 2014/0231054 | A1 | 8/2014 | Martins | |
| 2014/0262170 | A1 | 9/2014 | Buckrell et al. | |
| 2014/0284033 | A1 * | 9/2014 | Zima | F28F 3/08 165/166 |
| 2014/0029295 | A1 | 10/2014 | Kalbacher et al. | |
| 2015/0129186 | A1 | 5/2015 | Ooi et al. | |
| 2015/0211810 | A1 * | 7/2015 | Meguriya | F28F 3/08 165/166 |
| 2015/0241128 | A1 | 8/2015 | Gluck et al. | |
| 2015/0323266 | A1 * | 11/2015 | Bardeleben | F28F 3/025 165/76 |
| 2016/0018169 | A1 | 1/2016 | Powell et al. | |
| 2016/0097596 | A1 | 4/2016 | Stewart et al. | |
| 2017/0108283 | A1 | 4/2017 | Devedeux et al. | |

FOREIGN PATENT DOCUMENTS

| | | | |
|---|---|---|---|
| JP | S6186590 | A | 5/1986 |
| JP | H07159074 | A | 6/1995 |
| JP | H10331725 | A | 12/1998 |
| JP | 2000073878 | A | 3/2000 |
| WO | 2013092642 | A1 | 6/2013 |
| WO | 2015164968 | A | 11/2015 |

OTHER PUBLICATIONS

Machine-Generated English Translation of JPS 6186590, obtained via Espacenet Patent Search.
Machine-Generated English Translation of WO 2013092642, obtained via Espacenet Patent Search.
International Search Report and Written Opinion for Application No. PCT/CA2017/051220, dated Jan. 18, 2018.
English Machine Translation of JP 2000 073878A Mar. 7, 2000.
English Machine Translation of JP H10331725 A Dec. 15, 1998.
English Machine Translation of JP H07159074 A Jun. 20, 1995.

* cited by examiner

HEAT EXCHANGER HAVING AERODYNAMIC FEATURES TO IMPROVE PERFORMANCE

CROSS-REFERENCE TO RELATED APPLICATION

This application claims priority to and the benefit of U.S. Provisional Patent Application No. 62/408,216 filed Oct. 14, 2016 and U.S. Provisional Patent Application No. 62/537,772 filed Jul. 27, 2017, the contents of which are incorporated herein by reference.

FIELD

The present disclosure generally relates to heat exchangers for cooling a hot gas with a coolant, such as gas-liquid charge air coolers.

BACKGROUND

It is known to use gas-liquid heat exchangers to cool compressed charge air in turbocharged internal combustion engines or in fuel cell engines, or to cool hot engine exhaust gases. For example, compressed charge air is typically produced by compressing ambient air. During compression, the air can be heated to a temperature of about 200° C. or higher, and must be cooled before it reaches the engine.

Various constructions of gas-cooling heat exchangers are known. For example, gas-cooling heat exchangers commonly have an aluminum core comprised of a stack of flat tubes, with each tube defining an internal coolant passage. The tubes are spaced apart to define gas flow passages which are typically provided with turbulence-enhancing inserts to improve heat transfer from the hot gas to a liquid coolant.

The aluminum core may be enclosed within a housing formed from a dissimilar material such as plastic, the housing including inlet and outlet manifold covers which provide gas inlet and outlet openings and manifold spaces for distribution of the gas flow.

To reduce material costs, weight and complexity it is desirable to close the sides of the aluminum core and eliminate the sides of the housing. Heat exchangers having closed sides are referred to herein as "self-enclosed" heat exchangers. In a self-enclosed heat exchanger, the manifold covers must be connected and sealed directly to the core, while maintaining and maximizing cooling efficiency.

In some gas-liquid heat exchangers, it is desirable to provide gas flow passages at the top and bottom of the core in order to save space and reduce cost. However, the top and bottom gas flow passages will have higher outlet temperatures because they are in contact with only one of the coolant-carrying flat tubes.

There remains a need for improved efficiency in gas-cooling heat exchangers, by improved sealing between the manifold covers and the core, minimizing gas bypass flow, and/or by providing optimal heat exchange between the hot gas and the liquid coolant.

SUMMARY

In one aspect, there is provided a gas-liquid heat exchanger comprising a heat exchanger core having a top, a bottom, a pair of sides, an open front face and an open rear face, wherein a gas flow direction is defined through the core from the front face to the rear face, and wherein the core has a height defined between its top and bottom; wherein the core comprises: a plurality of flat tubes stacked in parallel relation to one another, each of the flat tubes enclosing a liquid flow passage for circulation of a liquid coolant; a plurality of gas flow passages, each of which is defined in a space between an adjacent pair of said flat tubes, wherein the gas flow passages are open at the front face and the rear face of the core; an end plate enclosing the top or bottom of the core, wherein an endmost gas flow passage is defined between the end plate and an adjacent one of said flat tubes, such that the endmost gas flow passage is in contact with only said adjacent one of said flat tubes; a blocking element extending along either the front face or the rear face of the core and at least partly blocking the endmost gas flow passage.

In another aspect, there is provided a gas-liquid heat exchanger comprising a heat exchanger core having a top, a bottom, a pair of sides, an open front face and an open rear face, wherein a gas flow direction is defined through the core from the front face to the rear face, and wherein the core has a height defined between its top and bottom; wherein the core comprises: a plurality of flat tubes stacked in parallel relation to one another, each of the flat tubes enclosing a liquid flow passage for circulation of a liquid coolant; a plurality of gas flow passages, each of which is defined in a space between an adjacent pair of said flat tubes, wherein the gas flow passages are open at the front face and the rear face of the core, and wherein the gas flow passages are provided with turbulence-enhancing inserts; wherein each of the flat tubes comprises a pair of core plates joined together at their peripheral edges to enclose and define a coolant flow passage; each of the core plates including a pair of bosses defining coolant manifold openings, wherein the bosses are aligned throughout the height of the core to define coolant inlet and outlet manifolds, and wherein each of the turbulence-enhancing inserts has an edge extending in the gas flow direction which is located adjacent to one side of at least one of the inlet and outlet manifold; wherein at least one of the core plates in each of the flat tubes includes a flap projecting into one of the gas flow passages, and positioned to cover a gas bypass channel between the edge of the turbulence-enhancing insert and the side of at least one of the inlet and outlet manifold.

BRIEF DESCRIPTION OF THE DRAWINGS

Specific embodiments will now be described, by way of example only, with reference to the accompanying drawings, in which.

DETAILED DESCRIPTION

Figure 1:
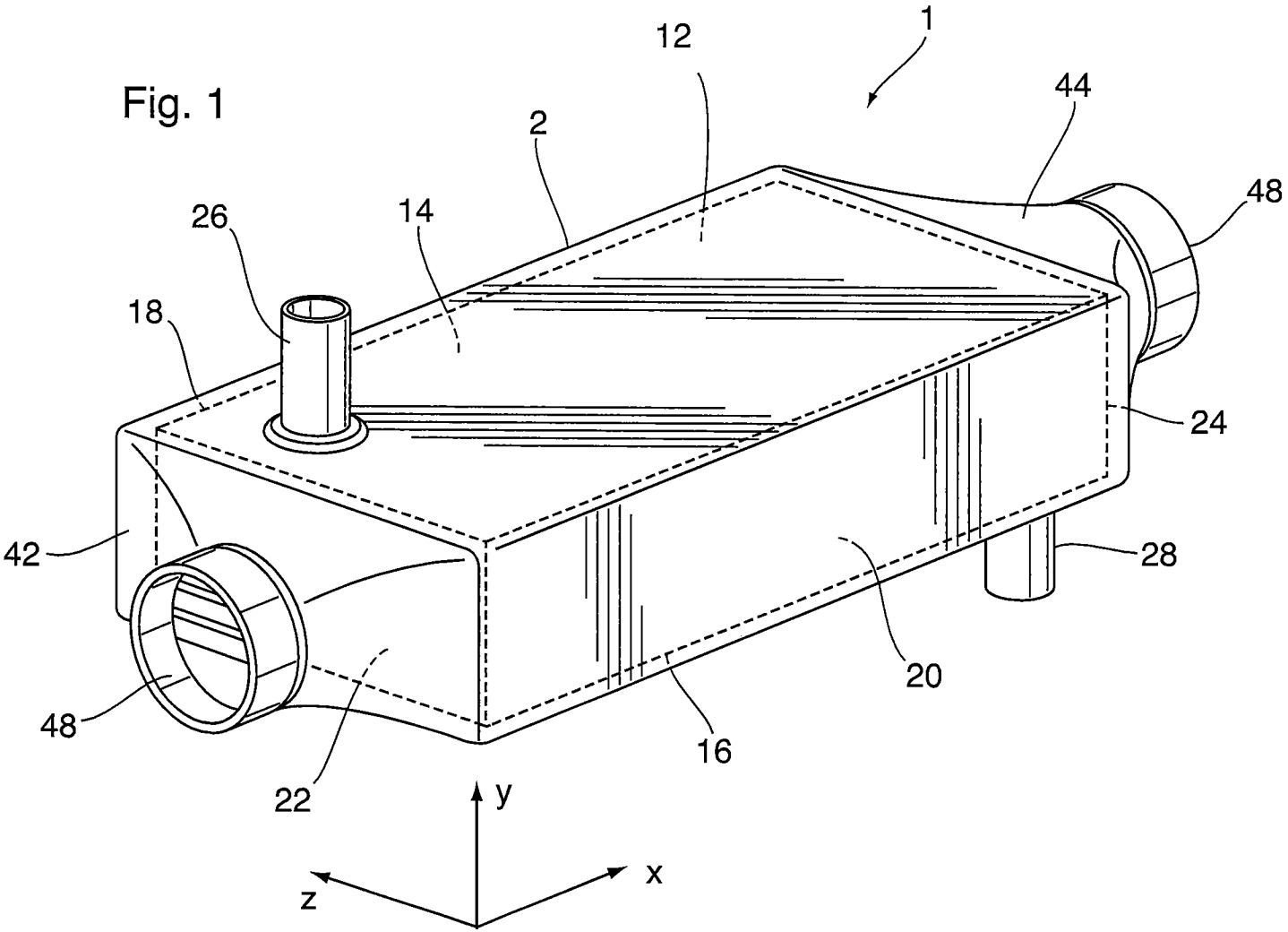
FIG. 1 is a perspective view showing the exterior of a heat exchanger according to a first embodiment disclosed herein.

Terms such as "front", "rear", "side", "top", "bottom", "upper", "lower", etc., are used herein as terms of convenience, and do not indicate that the heat exchangers described herein are required to have any particular orientation in use.

Throughout the description and drawings, like reference numerals are used to identify like elements of the various embodiments described herein.

The heat exchangers described below are charge air coolers for motor vehicles powered by an engine requiring compressed charge air, such as a turbocharged internal combustion engine or a fuel cell engine. Therefore, in the specific embodiments described herein, the gas which flows through the core is charge air. A liquid coolant is circulated through the core, which may be the same as the engine coolant, and may comprise water or a water/glycol mixture. The charge air coolers described herein may be mounted downstream of an air compressor and upstream of an air intake manifold of the engine to cool the hot, compressed charge air before it reaches the engine. In some embodiments the heat exchanger may be integrated with the intake manifold.

As used herein, the terms "fin" and "turbulizer" are intended to refer to corrugated turbulence-enhancing inserts having a plurality of axially-extending ridges or crests connected by sidewalls, with the ridges being rounded or flat. As defined herein, a "fin" has continuous ridges whereas a "turbulizer" has ridges which are interrupted along their length, so that axial flow through the turbulizer is tortuous. Turbulizers are sometimes referred to as offset or lanced strip fins, and examples of such turbulizers are described in U.S. Pat. No. Re. 35,890 (So) and U.S. Pat. No. 6,273,183 (So et al.). The patents to So and So et al. are incorporated herein by reference in their entireties.

A heat exchanger 1 according to a first embodiment is now described with reference to FIGS. 1 to 4.

Figure 2:
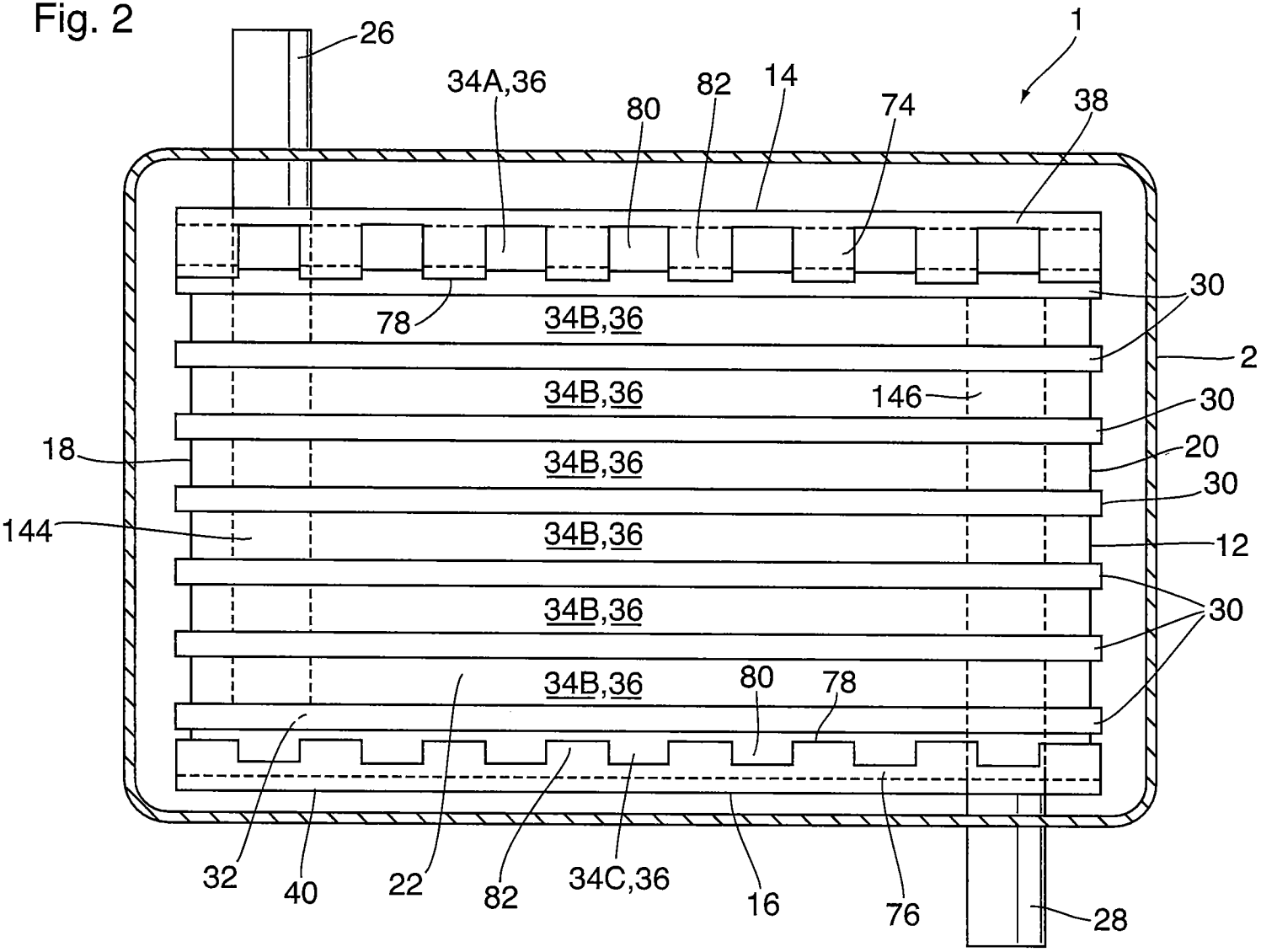
FIG. 2 is a front elevation view of the heat exchanger of FIG. 1, with a portion of the housing cut away.

As shown in FIGS. 1 and 2, heat exchanger 1 comprises a heat exchanger core 12 in the shape of a rectangular prism, the core 12 being enclosed within a housing 2. The core 12 has a top 14, a bottom 16, a pair of sides 18, 20, an open front face 22 and an open rear face 24. A gas flow direction is defined through the core, along the x axis, from the front face 22 to the rear face 24. Accordingly, the front face 22 defines a gas inlet of the core 12, while the rear face 24 defines a gas outlet, however, it will be appreciated that the direction of gas flow can be reversed.

A pair of coolant fittings 26, 28 project from the core 12 and through housing 2. Coolant fitting 26 is shown as being located adjacent to side 18 and front face 22 of core, while coolant fitting 28 is located adjacent to side 20 and rear face 24, and with fitting 26 projecting from the top 14 and fitting 28 projecting from the bottom 16. The location and arrangement of the coolant fittings 26, 28 are variable, and depend on the specific application. For example, the fittings 26, 28 can both be located adjacent to the same side 18, 20, one or both of the fittings 26, 28 can be located anywhere between sides 18, 20, both fittings 26, 28 may be provided on the top or the bottom 14, 16, and/or they may be aligned along the z axis or x axis.

The core 12 of heat exchanger 1 will typically be comprised of a metal such as aluminum or an aluminum alloy, with the components of core 12 being joined together by brazing, for example in a single brazing operation conducted in a brazing furnace. As used in relation to all embodiments described herein, the term "aluminum" is intended to include aluminum and its alloys. It will be appreciated that aluminum construction is not essential, and that the core 12 can be made of other metals, such as stainless steel. The housing 2 may be comprised partly or wholly of plastic and will typically comprise multiple segments to permit the core 12 to be inserted into housing 2. Although not shown, the heat exchanger 1 may include bypass blocking features to limit bypass gas flow between the core 12 and the inner surfaces of housing 2.

The core 12 comprises a plurality of flat tubes 30, each of which encloses a coolant flow passage 32. The tubes 30 are stacked along the y axis, with spaces between adjacent tubes 30 defining gas flow passages 34. The coolant flow passages 32 communicate with coolant fittings 26, 28 through coolant manifolds 144, 146 extending through the core 12. The coolant flow passages 32 and the gas flow passages 34 alternate with one another throughout the height of the core (along the y-axis). The gas flow passages 34 are open at the front face 22 and rear face 24 of the core 12, and are provided with turbulence-enhancing inserts 36, which are schematically illustrated as flat rectangular blocks in the drawings. The turbulence-enhancing inserts 36 may comprise simple corrugated fins comprising a plurality of continuous corrugations extending along the x axis, and comprising a plurality of ridges spaced apart along the x axis, with adjacent ridges connected by sidewalls which may be vertical (along the y axis) or angled.

The top 14 of core 12 is enclosed by a top plate 38 which forms an upper wall of an uppermost gas flow passage 34, and the bottom 16 of core 12 is enclosed by a bottom plate 40 which forms a bottom wall of a lowermost gas flow passage 34. The more general term "end plate" is sometimes used herein instead of "top plate" or "bottom plate", and the general term "endmost gas flow passage" is sometimes used herein instead of "uppermost gas flow passage" or "lowermost gas flow passage". In FIG. 2 the uppermost and lowermost gas flow passages are labeled 34A and 34C, respectively, and it can be seen they are each in contact with only one of the flat tubes 30 through which coolant is circulated.

The gas flow passages 34 located between the uppermost and lowermost gas flow passages 34A and 34C are sometimes referred to herein as "intermediate" gas flow passages, and are labeled 34B in FIG. 2. Each of the intermediate gas flow passages 34B is in contact with two flat tubes 30, located above and below each intermediate gas flow passage 34B. Therefore, it is expected that the amount of heat which can be removed from each of the intermediate gas flow passages 34B is greater than the amount of heat which can be removed from each of the uppermost and lowermost gas flow passages 34A, 34C. An obvious solution to this problem is to provide tubes 30 with coolant flow passages 32 at the top and bottom of the core 12. However, this increases cost and space requirements, and may not comply with some customer requirements. The inventors have discovered that it is possible to solve this problem in a simple manner, by diverting at least a portion of the gas flow from the uppermost and lowermost gas flow passages 34A, 34C to the intermediate gas flow passages 34B.

It will be appreciated that it is possible to construct a heat exchanger core 12 having a flat tube 30 with a coolant flow passage 32 at either the top or bottom of the core 12, such that the core 12 has only an uppermost or a lowermost gas flow passage 34A, 34C which is in contact with one flat tube 30. Such embodiments are within the scope of the present disclosure.

Figure 3:
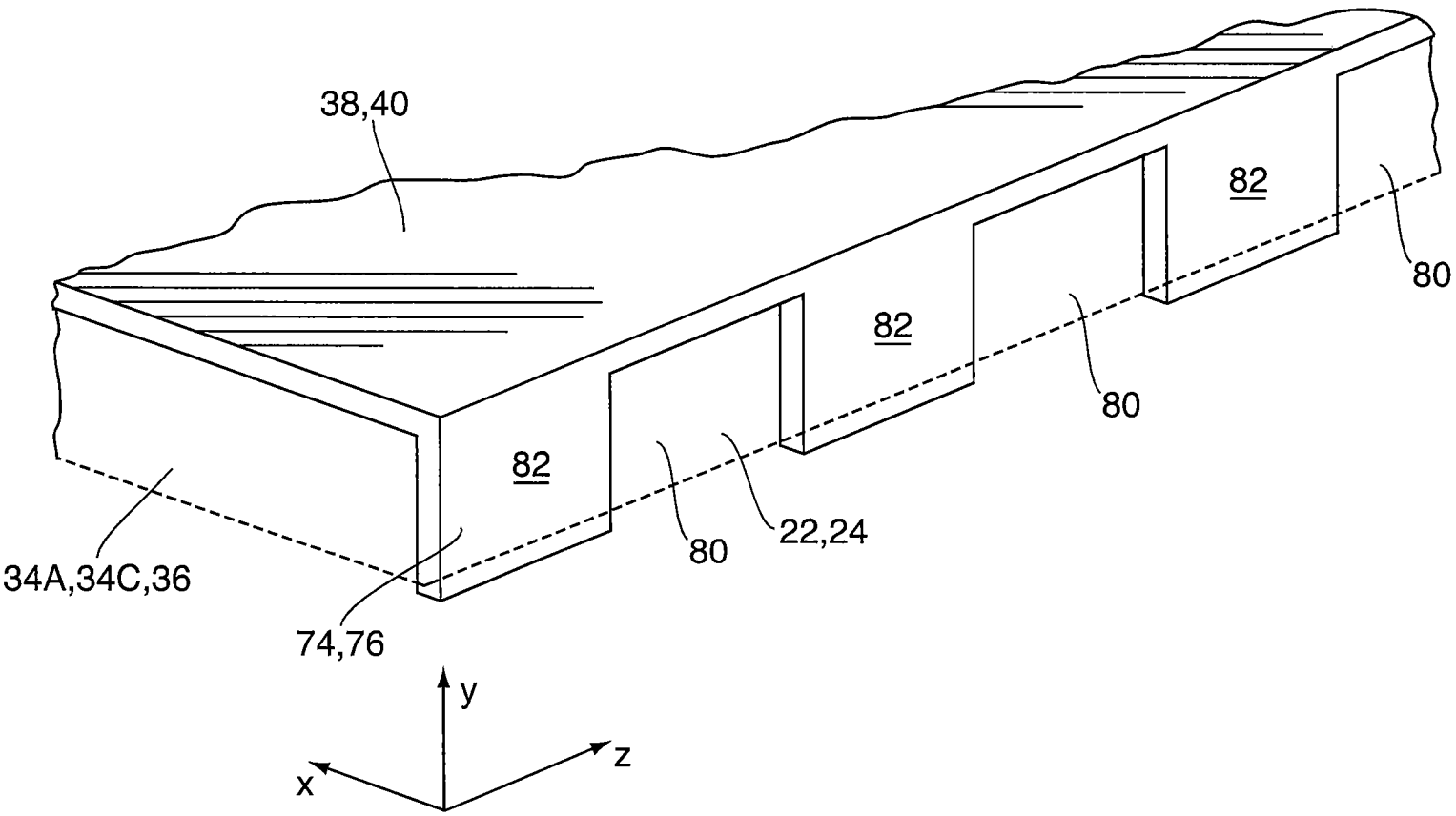
FIG. 3 is a close-up, partial perspective view showing the top or bottom plate of the heat exchanger of FIG. 1.
Figure 4:
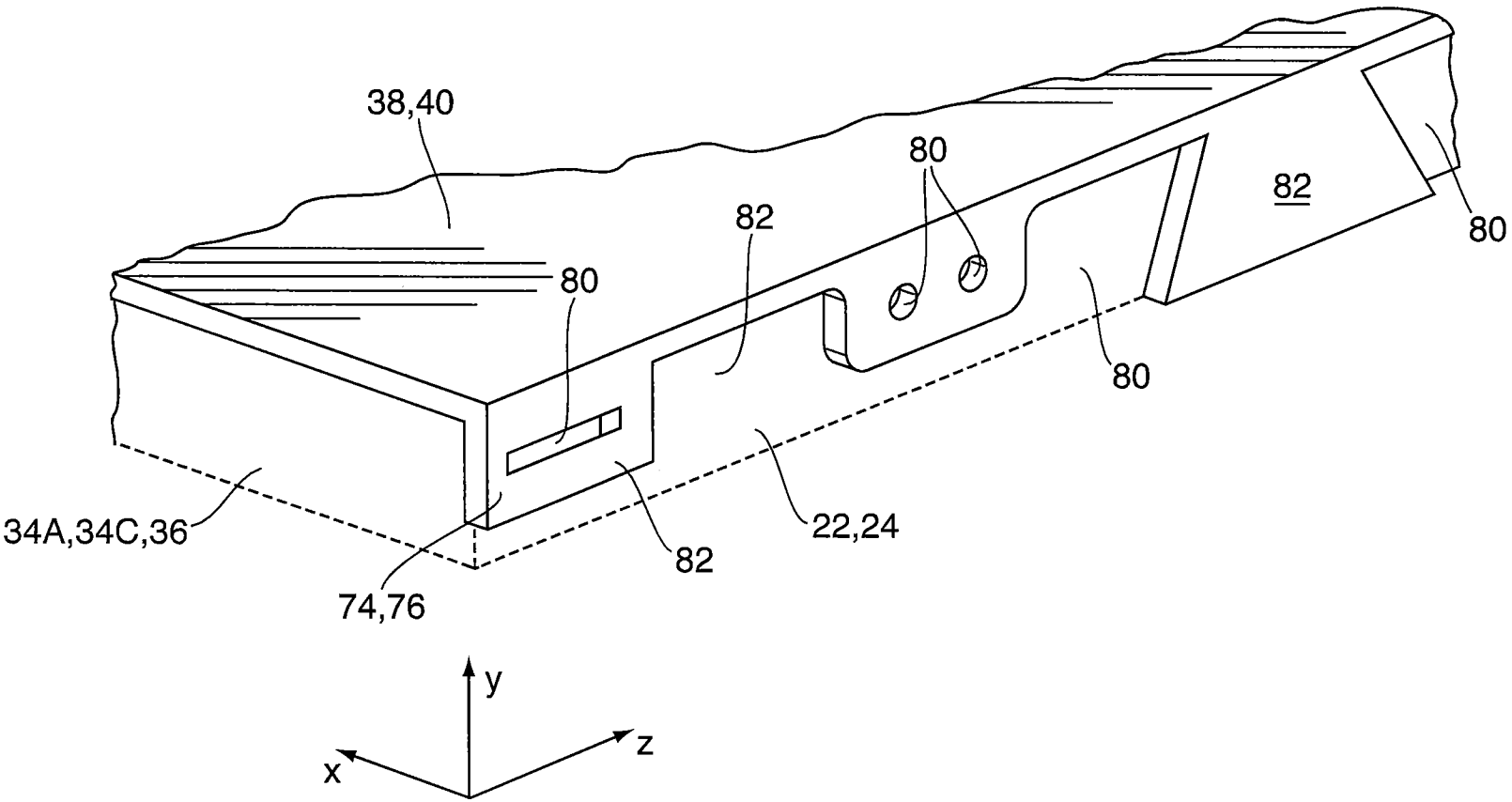
FIG. 4 is a view of a top or bottom plate similar to FIG. 3, but showing various configurations of the blocking flange.

In the present embodiment, the top plate 38 of core 12 is provided with a top blocking flange 74 along at least one of its forward or rearward edges, wherein the forward edge extends along the front face 22 of core 12, along the z axis, whereas the rearward edge extends along the rear face 24 of core 12. Similarly, the bottom plate 40 is provided with a bottom blocking flange 76 extending along at least one of its forward and rearward edges. Each of the top and bottom blocking flanges 74, 76 at least partially blocks gas flow from entering and/or exiting the respective uppermost and lowermost gas flow passages 34A, 34C. The top and bottom blocking flanges 76, 78 are shown in FIGS. 3 and 4 as being angled at about 90 degrees relative to the respective top and bottom plates 38, 40 and being integrally formed therewith, with the bend between each flange 74, 76 and the plate 38, 40 to which it is attached being located along the front face 22 or rear face 24 of core 12. It is not essential that the flanges 74, 76 are integrally formed with plates 38, 40. For example, the blocking flanges 74, 76 may be formed on separate plates which are secured to the respective top and bottom plates 38, 40.

Each of the blocking flanges 74, 76 has a height, measured along the y axis, from the point of attachment to plate 38, 40 to a distal free end 78, which is constant or variable along the length of the blocking flange 74, 76 (along the z axis). The height of the blocking flanges 74, 76 is such that the blocking flanges 74, 76 achieve complete or partial blocking of gas flow passages 34A and 34C along at least part of the front or rear face 22, 24 of core 12. For example, the maximum height of the blocking flanges 74, 76 may be the same as or slightly greater than the height of the gas flow passages 34A, 34C. It will be appreciated that a blocking flange 74 or 76 having this maximum height along its entire length will completely or substantially completely block the gas flow passage 34A or 34C. In order to achieve partial blocking of gas flow passages 34A and 34C, the blocking flanges 74, 76 may have a maximum height along their entire length which is less than the height of gas flow passages 34A, 34C, and/or the blocking flanges 74, 76 may be provided with one or more interruptions 80 along their length (along the z axis) to permit gas to flow through or around the blocking flange 74, 76. For example, the interruptions 80 may comprise one or more portions along the lengths of the blocking flange 74, 76 in which the height of the blocking flange 74, 76 is less than the maximum height, and may be zero. These interruptions 80 may take various forms.

In addition to permitting gas flow to and/or from gas flow passages 34A, 34C, the interruptions 80 may also generate turbulence within the gas flow, for example by causing swirling and/or acceleration, so as to enhance heat transfer with the coolant flowing through tubes 30.

For example, as shown in FIGS. 2 and 3, the rearward and/or forward edges of the top and bottom plates 38, 40 are provided with blocking flanges 74, 76 having a plurality of interruptions 80 in the form of rectangular notches extending from the free end 78 toward the point of attachment to the top or bottom plate 38 or 40, such that the blocking flanges 74, 76 each define a plurality of spaced apart rectangular tabs 82, wherein the interruptions 80 and tabs 82 are of variable height and width. The interruptions 80 permit some of the gas flow to enter and/or exit the uppermost and lowermost gas flow passages 34A, 34C, while the tabs 82 prevent at least some of the gas flow from entering and/or exiting the gas flow passages 34A, 34C.

The top and bottom blocking flanges 74, 76 are shown in FIG. 2 as having slightly different configurations. The top blocking flange 74 includes rectangular tabs 82 having a height which is at least as great as the height of the uppermost gas flow passage 34A, such that the tabs of top blocking flange 74 completely block a portion of uppermost gas flow passage 34A. The interruptions 80 of top blocking flange 74 comprise rectangular notches having a height of zero which leave a portion of the uppermost gas flow passage 34A completely open. Therefore the top blocking flange 74 has a maximum height (at tabs 82) which is equal to or greater than the height of uppermost gas flow passage 34A, and a minimum height of zero (at notches 80).

The bottom blocking flange 76 also includes rectangular tabs 82 and rectangular notches 80, however the maximum height of the bottom blocking flange 76 at tabs 82 is less than the height of the lowermost gas flow passage 34C and the minimum height at notches 80 is also less than the height of passage 34C. Therefore, both the tabs 82 and notches 80 of bottom blocking flange 76 achieve partial blocking of the lowermost gas flow passage 34C.

The partial blocking of the uppermost and lowermost gas flow passages 34A, 34C provided by the blocking flanges 74, 76 improves the overall performance of heat exchanger 1 by diverting some of the gas flow from the uppermost and lowermost gas flow passages 34A, 34C to the intermediate gas flow passages 34B, which have greater cooling capacity. Also, as further discussed below, the blocking flanges 74, 76 may provide some redistribution of the gas flow along the z axis, i.e. transverse to the gas flow direction, for example so as to minimize direct contact between the hot gases and the coolant manifolds 144, 146. Thus, the blocking flanges 74, 76 may be of greater height or have fewer interruptions 80 in the vicinities of the coolant manifolds 144, 146.

The housing 2 of heat exchanger 1 covers the top, bottom and sides 14, 16, 18, 20 of core 12. The housing 2 also includes manifold covers 42, 44 covering the front face 22 and rear face 24 of the core 12, the manifold covers 42, 44 including gas openings 48 to allow gas to enter and exit the core 12. In other embodiments, the core 12 may be "self-enclosing", meaning that one or more of the portions of the housing 2 covering the top, bottom and sides 14, 16, 18, 20 of core 12 can be eliminated. The presence or absence of housing 2 is not material to the present embodiment.

As mentioned above, blocking flanges 74, 76 may have a wide variety of configurations. FIG. 4 is a view similar to FIG. 3, showing some of these alternate configurations. For example, FIG. 4 shows that the interruptions 80 may comprise apertures of various shapes, such as slots or round holes, these interruptions being provided in a blocking flange 74, 76 which is otherwise of constant or variable height. As also shown in FIG. 4, the tabs 82 and notches 80 may have angular or rounded edges, and/or may have sloped edges so that the tabs 82 and notches 80 are wedge-shaped.

While it may be convenient to integrate the blocking flanges 74, 76 with the top and bottom plates 38, 40, this is not essential. The blocking flanges 74, 76 could instead be integrated with the housing 2 or with a separate reinforcing plate, or could be formed as a separate component which is applied along the front face 22 or rear face 24 of core 12. Furthermore, it is not essential to provide blocking flanges 74, 76 along both the front and rear faces 22, 24 of core 12. For example, the top and bottom plates 38, 40 of heat exchanger 1 could instead be provided with blocking flanges 74, 76 along only one of its forward and rearward edges.

A heat exchanger 10 according to a second embodiment is now described below with reference to FIGS. 5 to 25.

Figure 5:
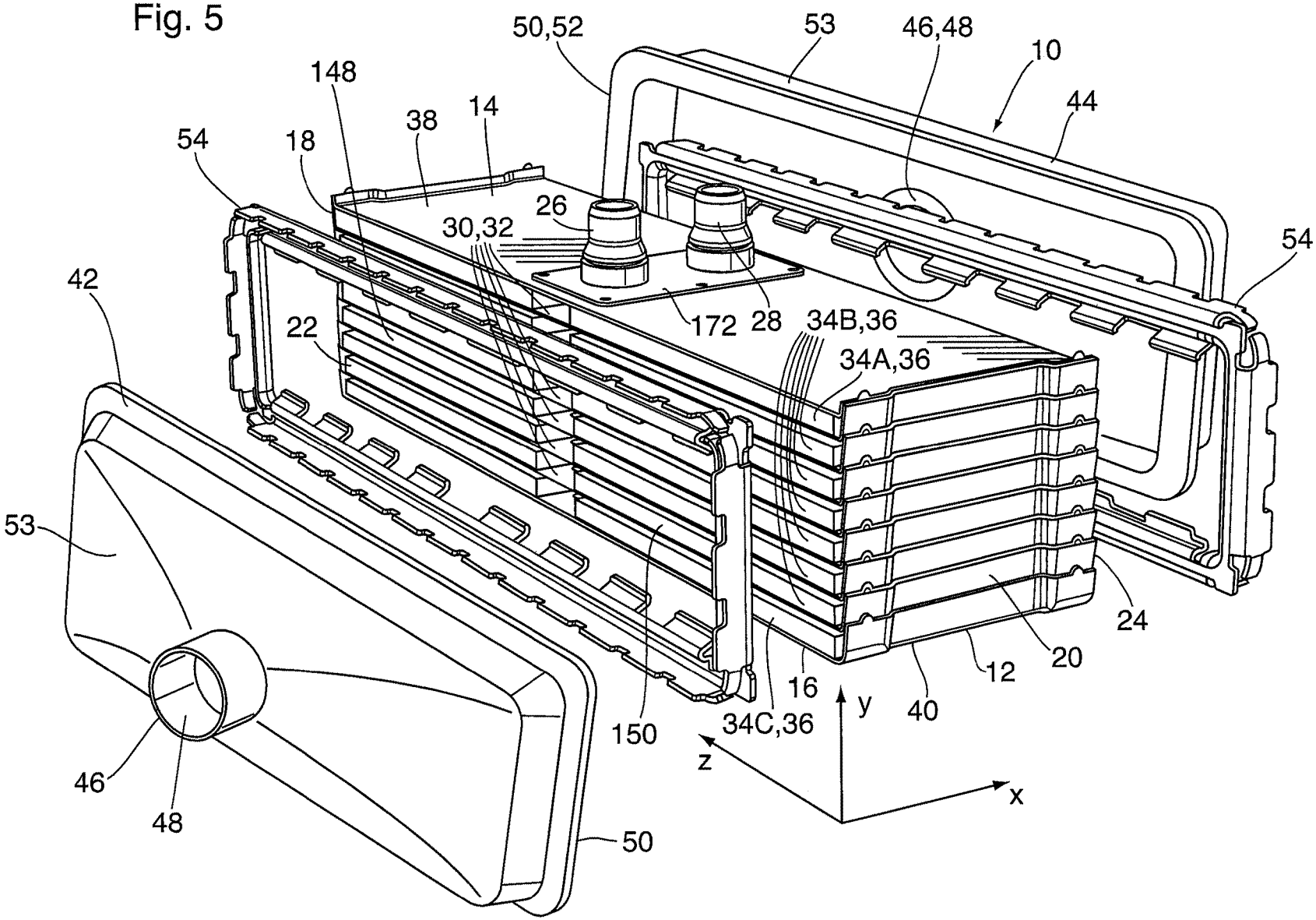
FIG. 5 is a partly disassembled perspective view of a heat exchanger according to a second embodiment.

FIG. 5 shows a heat exchanger 10 comprising a heat exchanger core 12 in the shape of a rectangular prism which is elongated along the z axis. The core 12 has a top 14, a bottom, a pair of closed sides 18, 20, an open front face 22 and an open rear face 24. A gas flow direction is defined through the core 12, along the x axis, from the front face 22 to the rear face 24. Accordingly, the front face 22 defines a gas inlet of the core 12, while the rear face 24 defines a gas outlet, however, it will be appreciated that the direction of gas flow can be reversed.

A pair of coolant fittings 26, 28 project from the top 14 of core 12, are aligned along the gas flow direction (x axis), and are located approximately midway between the sides 18, 20 of core 12. The coolant manifolds 144, 146 are likewise centrally aligned along the x axis. However, the location and arrangement of the fittings 26, 28 is variable, depending on the specific application. For example, both fittings 26, 28 can be located adjacent to one side 18 or 20, adjacent to opposite sides 18 and 20, and/or they may be aligned along the z axis. Furthermore, one or both of the coolant fittings 26, 28 may be located on the bottom 16 of core 12.

The core 12 of heat exchanger 10 will typically be comprised of a metal such as aluminum, an aluminum alloy or stainless steel, with the components of core 12 being joined together by brazing, for example in a single brazing operation in a brazing furnace.

Figure 6:
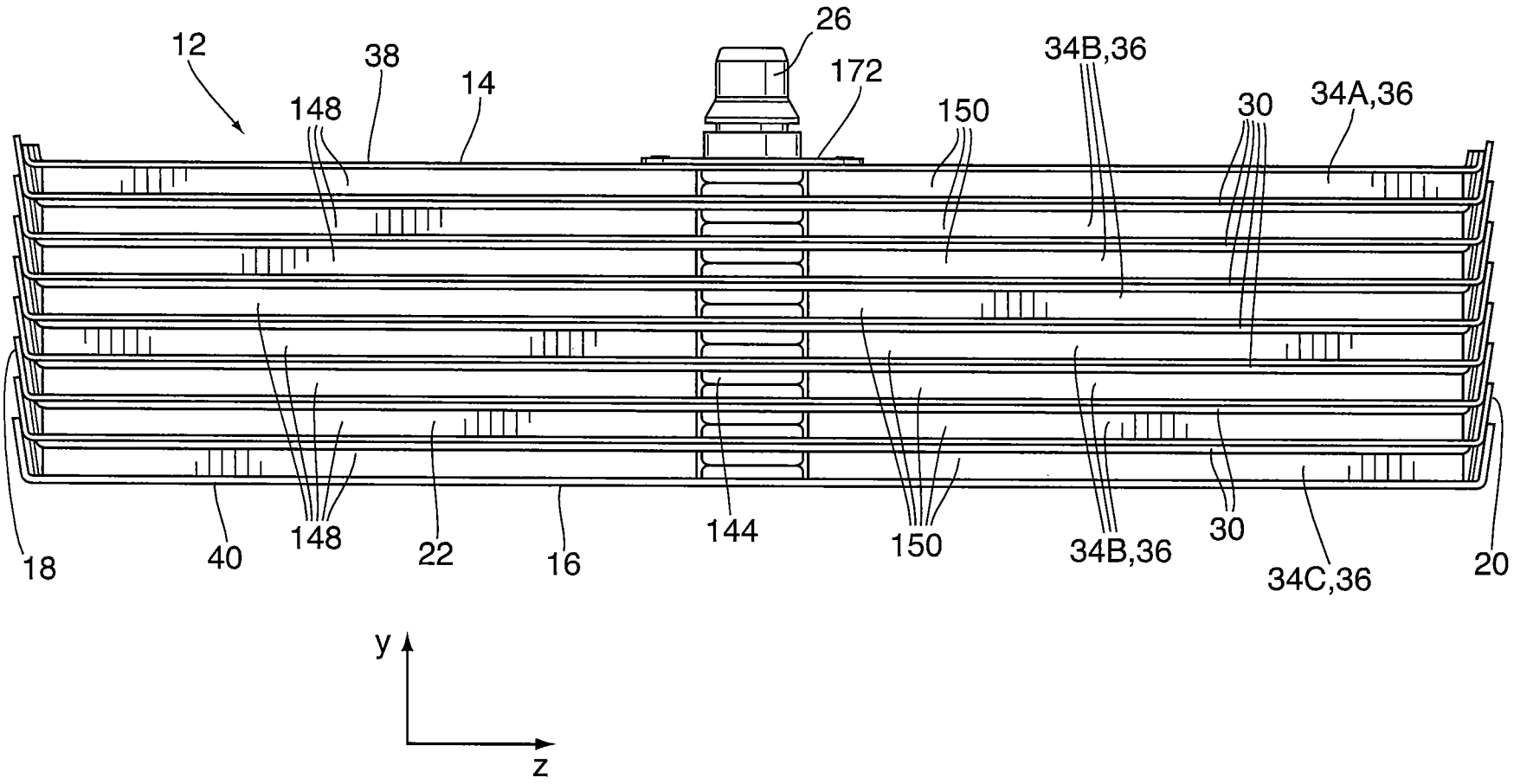
FIG. 6 is a front elevation view of the heat exchanger of FIG. 5, showing the heat exchanger core in isolation.
Figure 7:
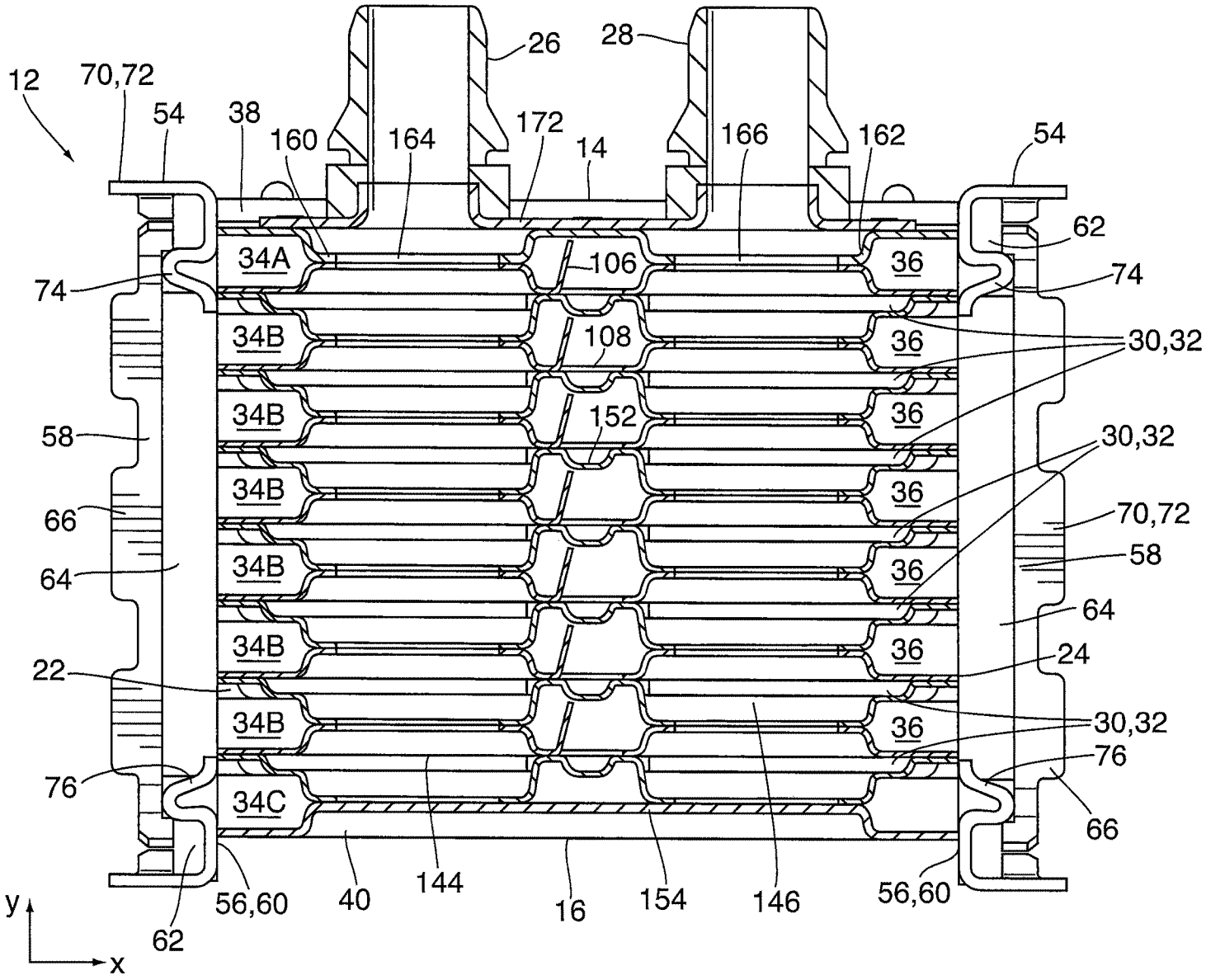
FIG. 7 is a cross-section through the core of the heat exchanger of FIG. 5, in a central x-y plane.
Figure 8:
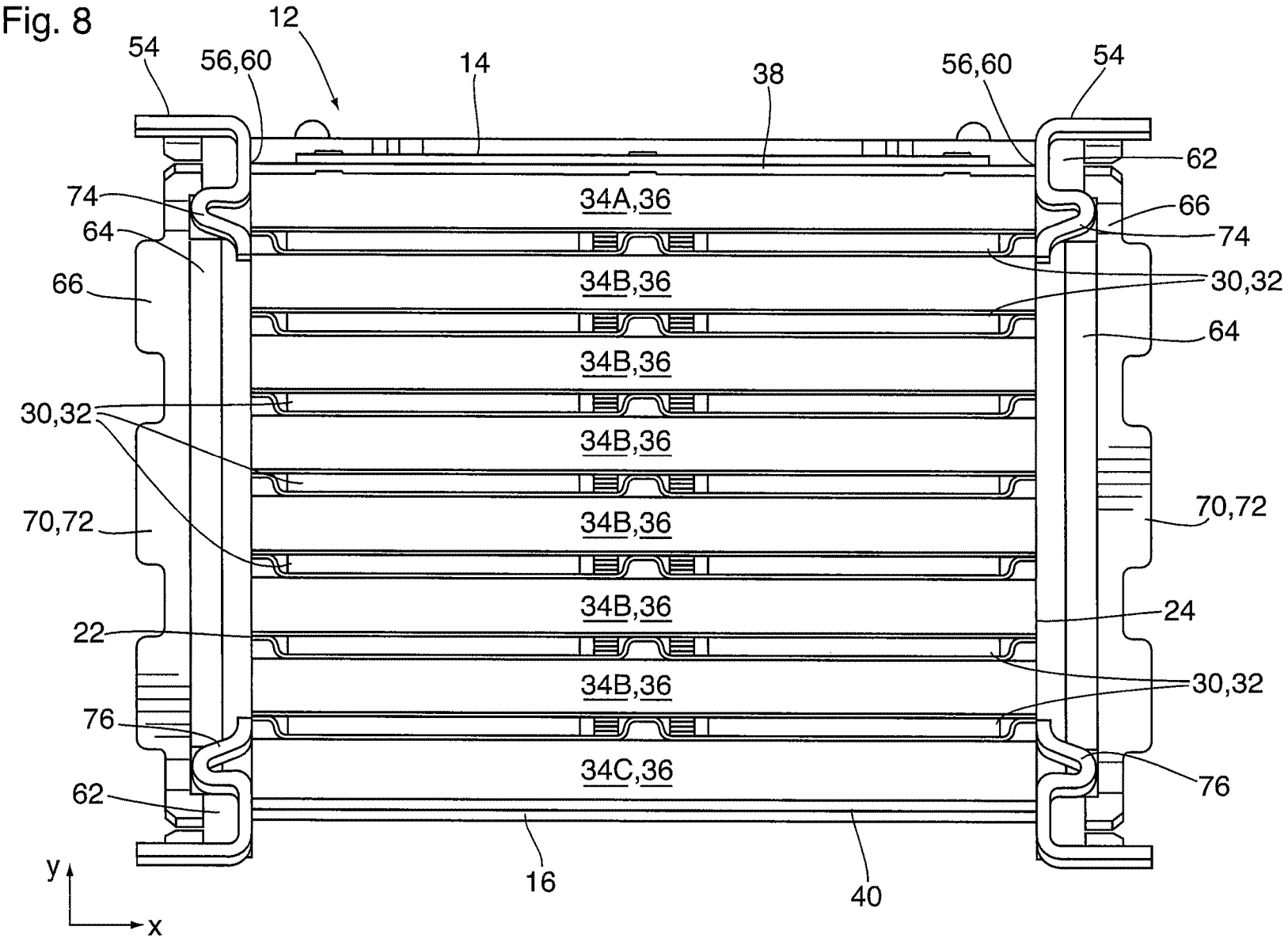
FIG. 8 is a cross-section through the core of the heat exchanger of Figure in an x-y plane located between the fittings and one of the sides of the core.

The core 12 comprises a plurality of flat tubes 30, each of which encloses a coolant flow passage 32, as best seen in the cross sections of FIGS. 6 to 8. The tubes 30 are stacked along the y axis, with spaces between adjacent tubes 30 defining gas flow passages 34. Thus, the coolant flow passages 32 and the gas flow passages 34 alternate with one another throughout the height of the core 12 (along the y-axis). The gas flow passages 34 are provided with turbulence-enhancing inserts 36, which are schematically illustrated as flat rectangular blocks in the drawings, and which may be corrugated fins as in heat exchanger 1 described above. In the present embodiment, the turbulence-enhancing inserts 136 are split into two sections 148, 150 (shown in FIGS. 5 and 6) due to the central location of the coolant manifolds 144, 146.

The gas flow passages 34 are open at the front face 22 and rear face 24 of the core 12, and are enclosed by the sides 18, 20 of the core 12. It will be seen that the top 14 of core 12 is enclosed by a top plate 38 which forms an upper wall of an uppermost gas flow passage 34, and the bottom 16 of core 12 is enclosed by a bottom plate 40 which forms a bottom wall of a lowermost gas flow passage 34. The uppermost and lowermost gas flow passages 34A, 34C are each in contact with only one of the flat tubes 30 through which the coolant is circulated, and the intermediate gas flow passages 34B are each in contact with two flat tubes 30. Therefore, the amount of heat which can be removed from each of the intermediate gas flow passages 34B is greater than the amount of heat which can be removed from each of the uppermost and lowermost gas flow passages 34A, 34C.

Additional structural details of the core 12 are described below.

The front and rear faces 22, 24 of core 12 are covered by front and rear manifold covers 42, 44, shown in FIG. 5. Each of the manifold covers 42, 44 comprises a first end 46 having a gas inlet or outlet opening 48 and being adapted for connection to an upstream or downstream component of a charge air supply system, such as a compressor or an intake manifold, and/or to gas flow conduits which are connected to the upstream or downstream components. Each of the manifold covers 42, 44 further comprises a second end 50 which is open and is adapted for connection to the front face 22 or rear face 24 of the core 12, the second end 50 being provided with a peripheral connecting flange 52, the structure of which is further described below. Each of the manifold covers 42, 44 further comprises a wall 53 extending between the first and second ends 46, 50 and enclosing a manifold space providing gas flow communication between the one of the gas openings 48 and the gas flow passages 34 through the front face 22 or rear face 24 of the core 12.

The manifold covers 42, 44 described and shown herein are of a simple structure, and it will be appreciated that the configurations of manifold covers 42, 44 are highly variable and will vary from one application to another. Furthermore, one or both of the manifold covers 42, 44 may be integrated with another component of the charge air supply system, such as the intake manifold. Therefore, the scope of the embodiments described herein is not to be limited by the configurations of the manifold covers 42, 44. Due to the complex and variable nature of the shapes which may be assumed by manifold covers 42, 44, these components are typically molded from plastic.

The manifold covers 42, 44 are sealingly connected to the core 12 at the front and rear faces 22, 24 thereof. For this purpose, heat exchanger 10 further comprises a pair of frame-like connecting elements 54, one of which provides a sealed connection between the front manifold cover 42 and the front face 22 of core 12, and the other providing a sealed connection between the rear manifold cover 44 and the rear face 24 of core 12.

The connecting elements 54 may be identical to each other, and are formed from a metal such as aluminum. The connecting elements 54 may be sealingly secured to the front and rear faces 22, 24 of the core 12 by welding. The connecting elements 54 are typically attached to the core 12 after it has been brazed together, since the height of the core 12 will typically change during brazing, due to the melting of the cladding layers on the core components during brazing, to form liquid filler metal.

Figure 9:
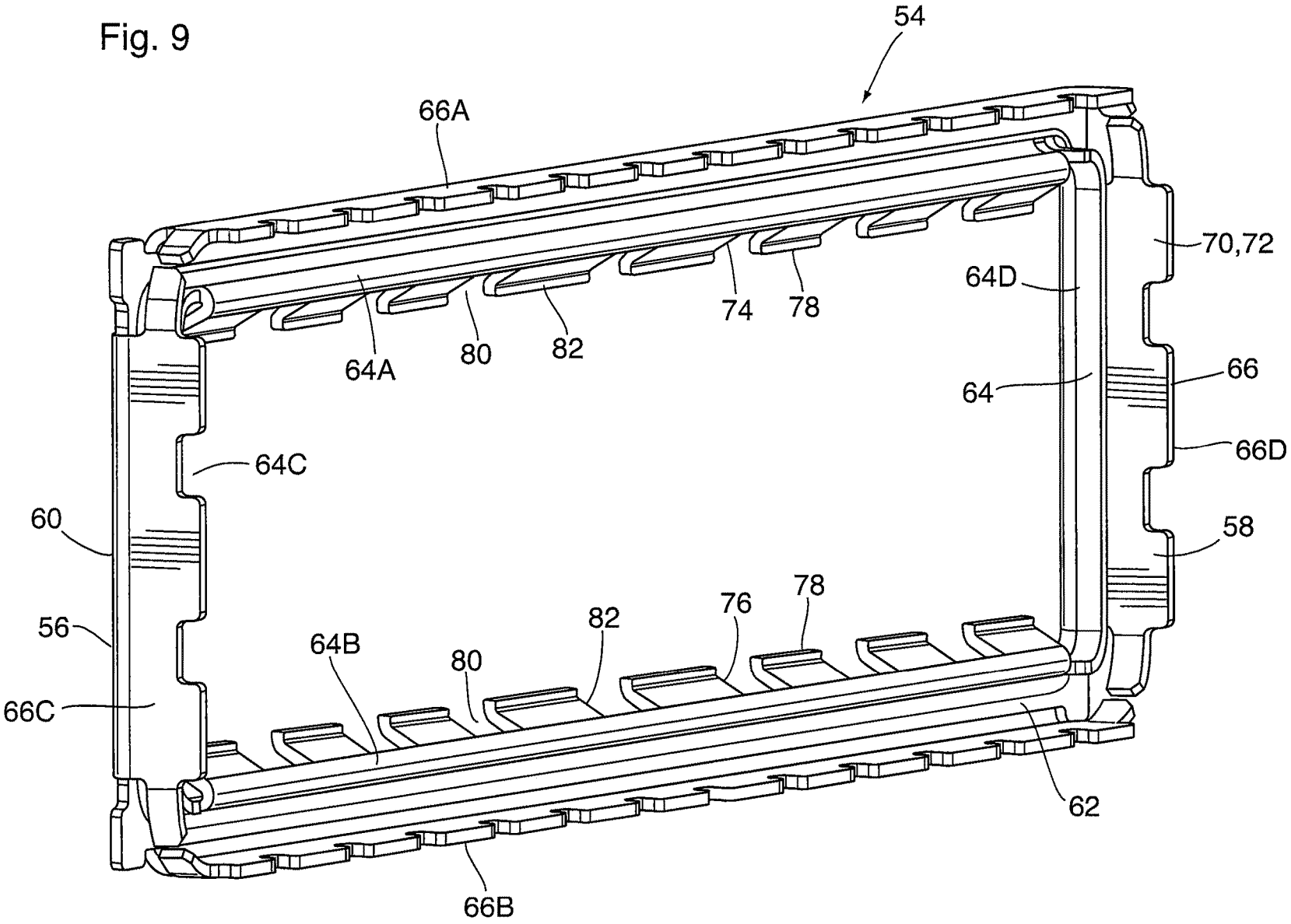
FIG. 9 is an isolated view of a connecting element of the heat exchanger of FIG. 5.
Figure 10:
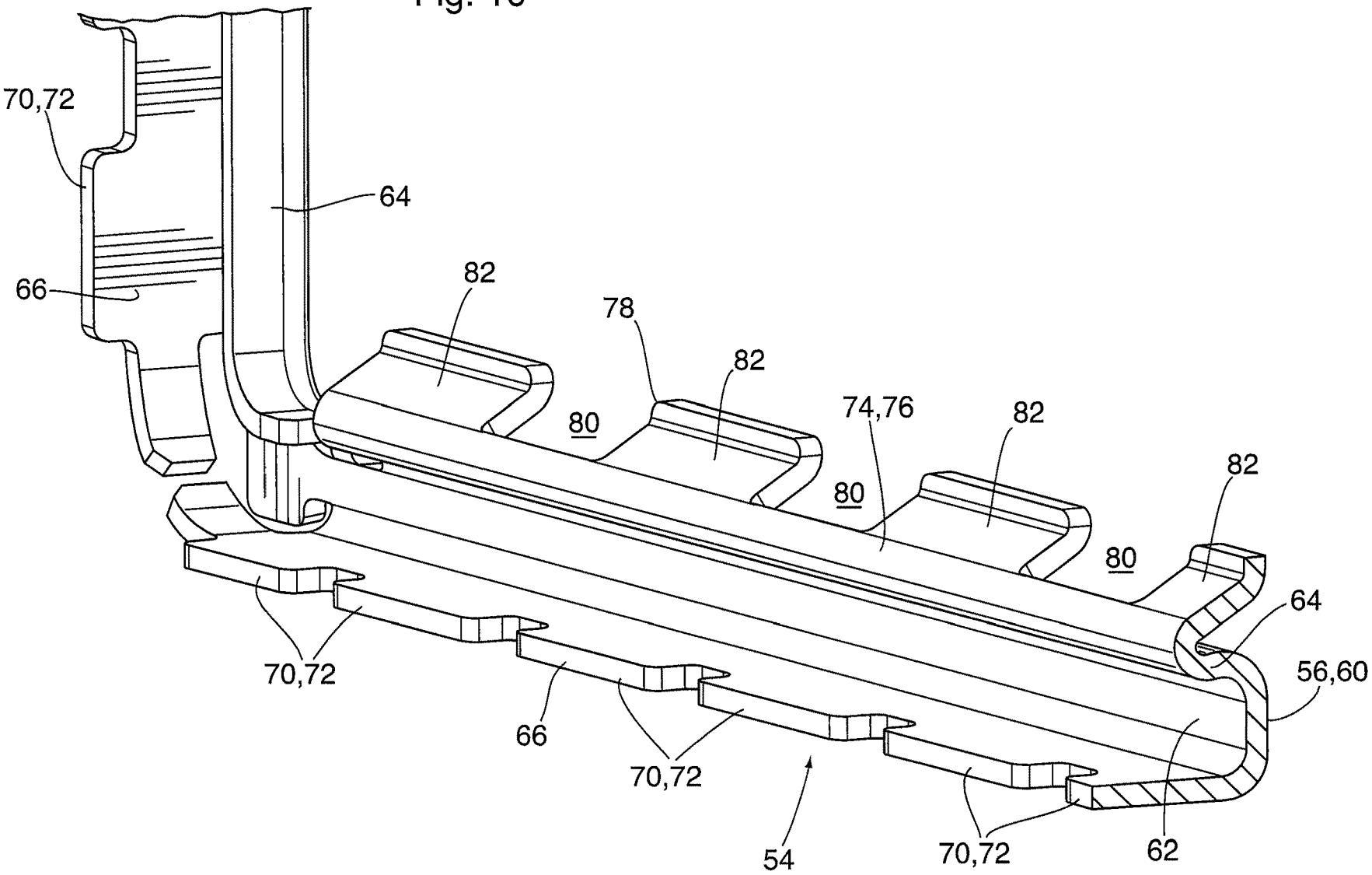
FIG. 10 is an enlarged, partial cross section through the top or bottom portion of the connecting element shown in FIG. 9.
Figure 11:
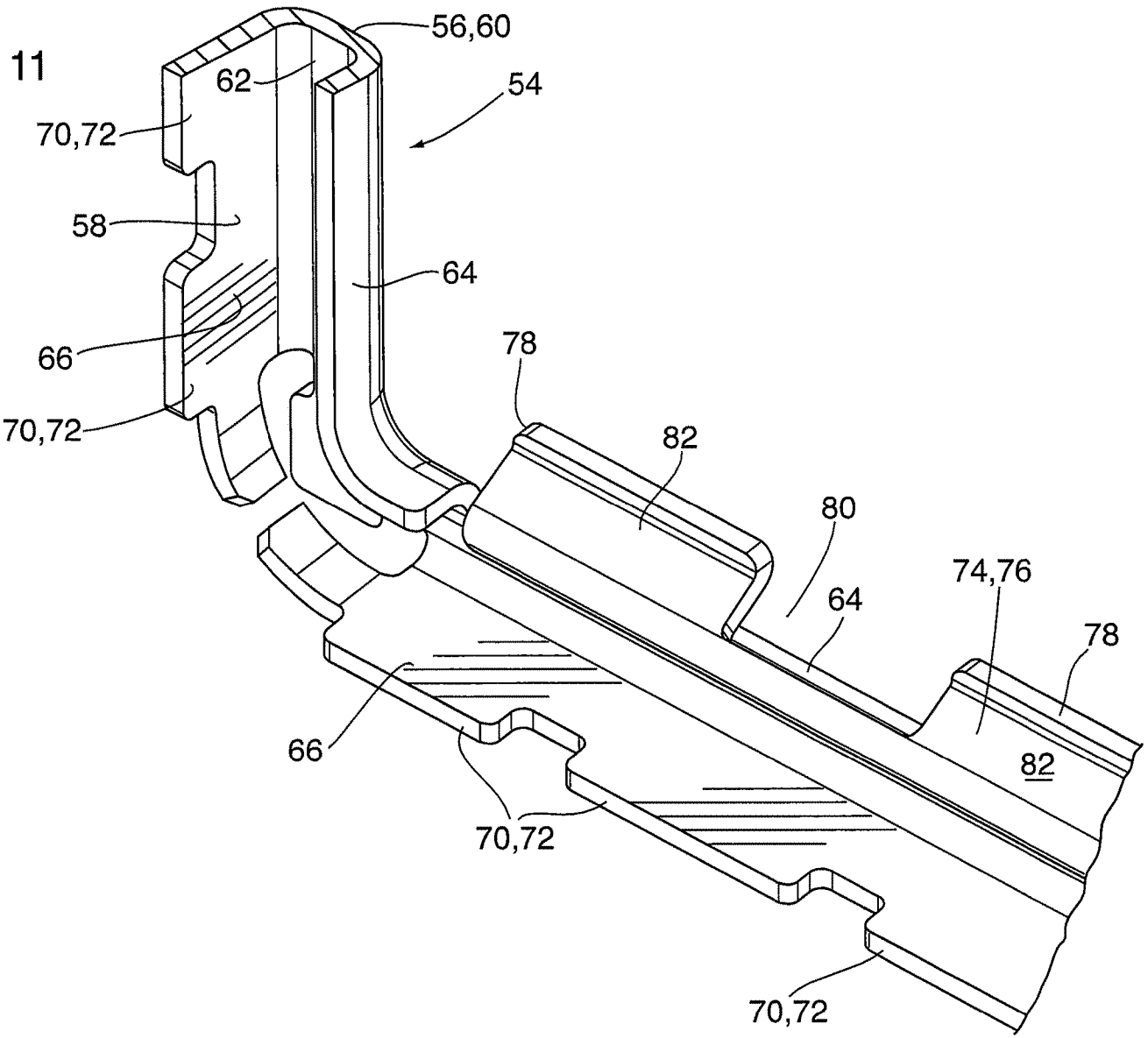
FIG. 11 is an enlarged, partial cross section through one of the side portions of the connecting element shown in FIG. 9.

FIGS. 9 to 11 are isolated views of the connecting element 54 and portions thereof. Each connecting element 54 comprises a frame member conforming to the shape of the front face 22 or rear face 24 of the core 12, which in this case is a rectangle elongated along the z axis. The connecting element 54 has a first (rear) side 56 along which it is attached to the core 12 and a second (front) side 58 along which it is attached to one of the manifold covers 42, 44.

In the present embodiment, the first side 56 of the connecting element 54 is adapted to abut the front face 22 or rear face 24 of the core 12, and to be secured thereto by welding. Therefore, the first side 56 of connecting element 54 includes a flat planar surface 60 extending continuously about the periphery of the connecting element 54.

The second side 58 of connecting element 54 comprises a peripheral groove 62 surrounded by an inner peripheral wall 64 and an outer peripheral wall 66 spaced apart from one another, both the inner and outer walls 64, 66 following the rectangular peripheral shape of the front and rear faces 22, 24 of core 12, and the rectangular shape of the connecting flange 52 of each manifold cover 42, 44. The walls 64, 66 each have top, bottom and side portions (labeled 64A-D and 66A-D in FIG. 9) corresponding to the top 14, bottom 16 and sides 18, 20 of core 12.

Figure 12:
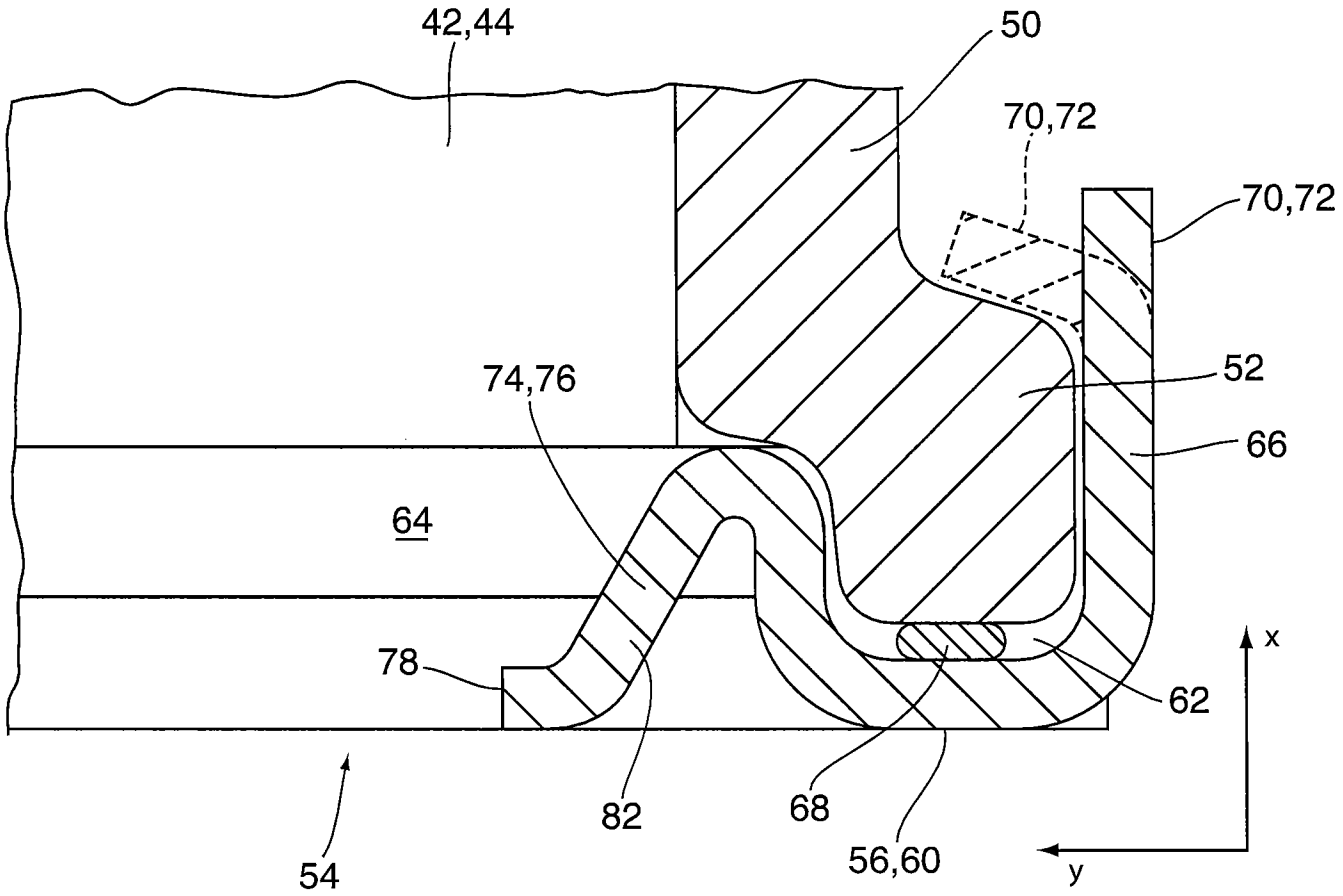
FIG. 12 shows a sealing arrangement between the connecting element of FIG. 9 and one of the manifold covers.

The formation of a sealed connection between a connecting element 54 and one of the manifold covers 42, 44 is now described with reference to FIG. 12. The groove 62 is adapted to receive a resilient sealing element 68, such as a gasket material comprising elastomeric foam, and to receive the connecting flange 52 of a manifold cover 42, 44. The outer wall 66 of the connecting element 54 extends at least generally along the x axis, and includes a deformable free end 70 which, in the present embodiment, comprises a plurality of bendable tabs 72 which are spaced apart from one another along the entire peripheral length of outer wall 66, i.e. along the top, bottom and sides 14, 16, 18, 20 of core 12. After the connecting flange 52 of a manifold cover 42, 44 is inserted into groove 62, the tabs 72 are bent inwardly to secure the manifold cover 42, 44 and compress the resilient sealing material 68, thereby providing a gas-tight seal.

The inner wall 64 of connecting element 54 partly defines the groove 62 which retains and seals the peripheral flange 52, and includes a portion which extends at least generally along the x axis. In the illustrated embodiment, the side portions of inner wall 64 (labeled 64C and 64D in FIG. 9) are in the form of simple upstanding walls extending at least generally along the x axis. Therefore, along the side portions of walls 64, 66, the connecting element has a substantially U-shaped or 3-shaped cross section as shown in FIG. 11.

The top and bottom portions of the inner wall 64 (64A and 64B in FIG. 9) have a more complex configuration, for reasons which will now be discussed. As discussed above, the hot gas flowing through the uppermost and lowermost gas flow passages 34A, 34C is cooled by contact with only one of the flat tubes 30 through which the coolant is circulated. Therefore, the amount of heat removed from the gas flowing through each of the uppermost and lowermost gas flow passages 34A, 34C will be less than that removed from the gas flowing through each of the intermediate gas flow passages 34B. As mentioned above, this problem can be addressed by providing coolant flow passages 32 at the top and bottom of the core 12. However, in addition to increasing cost and space requirements, this solution can present additional challenges in a heat exchanger using welded connecting elements 54, since welding the connecting element 54 to the edges of tubes 30 can create coolant leaks.

Heat exchanger 10 also includes top and bottom blocking flanges 74, 76 to at least partially block gas flow through the uppermost and lowermost gas flow passages 34A, 34C. In the present embodiment the blocking flanges 74, 76 are conveniently provided in the connecting elements 54 rather than in the top and bottom plates 38, 40.

The top blocking flange 74 may extend from the free end of the top portion 64A of inner peripheral wall 64, and the bottom blocking flange 76 may similarly extend from the free end of the bottom portion 64B of inner peripheral wall 64. The blocking flanges 74, 76 are angled relative to the inner wall 64, toward the vertical direction (y axis), so as to achieve at least partial blocking of the uppermost and lowermost gas flow passages 34A, 34C. It will be appreciated that the top and bottom portions 64A, 64B of the inner peripheral wall 64 may also partially block the uppermost and lowermost gas flow passages 34A, 34C, and therefore the top and bottom inner wall portions 64A, 64B can be regarded as comprising part of respective blocking flanges 74, 76 in the present embodiment.

Figure 13:
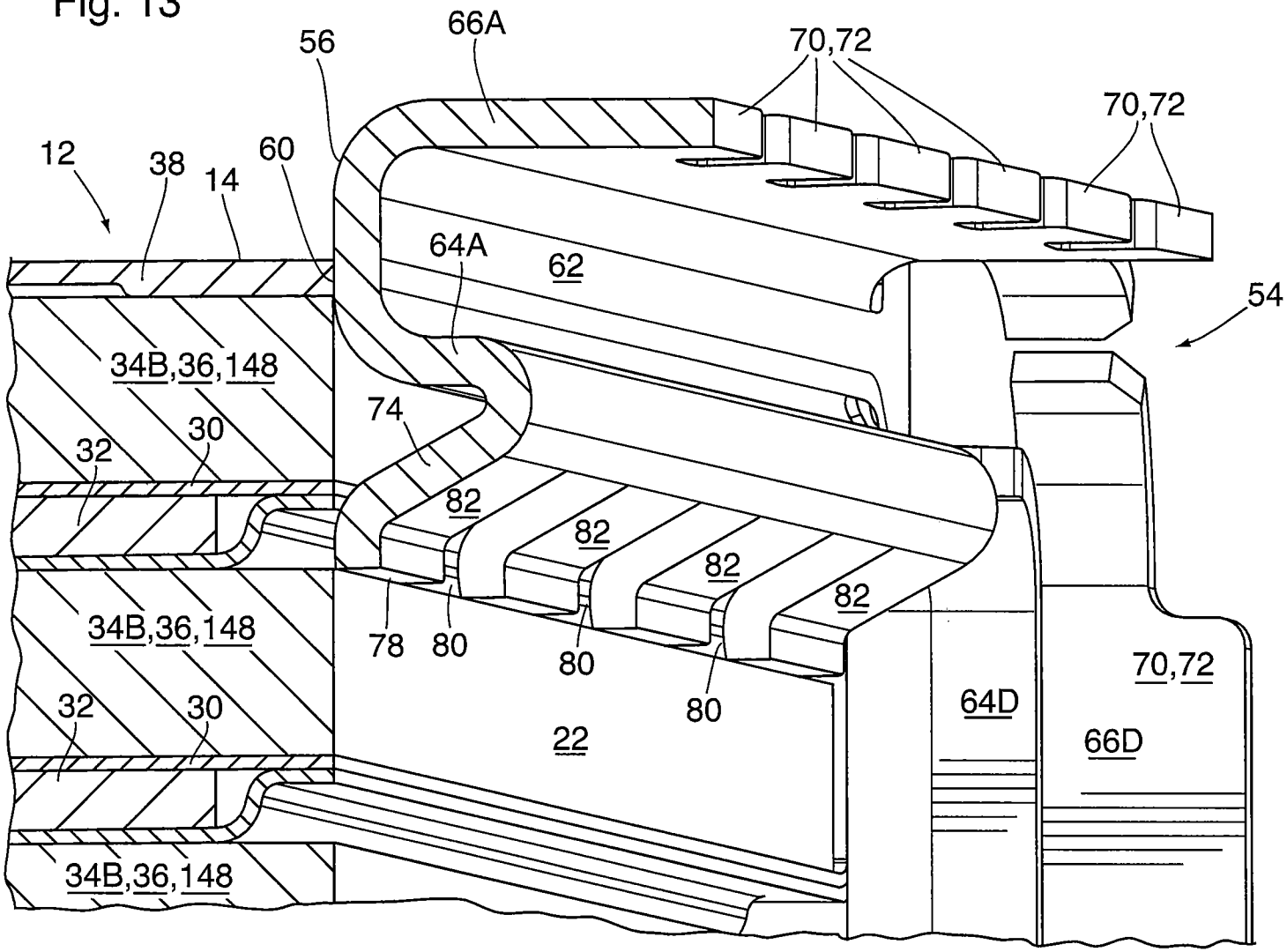
FIG. 13 is a close-up perspective cross-sectional view of a connecting element attached to the front face or rear face of the core.

As shown in FIG. 13, each of the top and bottom blocking flanges 74, 76 are bent back from the free end of inner peripheral wall 64 toward the first side 56 of the connecting element 54, such that an included angle between the inner wall 64 and the attached top or bottom blocking flange 74, 76 is less than 90 degrees, for example about 30-60 degrees. Thus, the blocking flanges 74, 76 form surfaces which are sloped toward the front face 22 or rear face 24 of the core 12, and are adapted to direct a portion of the gas flow toward the vertical direction, away from the uppermost and lowermost gas flow passages 34A, 34C and toward the intermediate gas flow passages 34B.

The blocking flanges 74, 76 each have a free end 78 distal from the point of attachment to inner wall 64, the free end 78 being rocated so as to achieve complete or partial blocking of gas flow passage 34A or 34C. As shown in FIG. 13, the terminal ends 78 may extend along the direction of the y axis past the gas flow passage 34A or 34C to the adjacent tube 30, and the terminal ends 78 are optionally bent so as to be parallel to the y axis.

It will be appreciated that a blocking flange 74 or 76 having a constant height equal to the maximum height of the tabs 82 in FIG. 13, and being free of interruptions, will completely or substantially completely block the gas flow passage 34A or 34C. In order to achieve partial blocking of gas flow passages 34A and 34C, the blocking flanges 74, 76 may either be reduced in height (along the y axis) and/or may be provided with one or more interruptions 80 along their length (along the z axis). These interruptions 80 may take various forms.

For example, in the present embodiment, the blocking flanges 74, 76 are each provided with a plurality of interruptions 80 in the form of rectangular notches extending from the free end 78 toward the point of attachment to inner wall 64, such that the blocking flanges 74, 76 each define a plurality of spaced apart rectangular tabs 82. As shown in FIG. 13, the interruptions 80 will permit some gas flow to enter the uppermost gas flow passage 34A, while the tabs 82 prevent some of the gas flow from entering the gas flow passage 34A. The same partial blocking arrangement is provided by bottom blocking flange 76. Therefore, the connecting element 54 of the present embodiment achieves partial blocking of the uppermost and lowermost gas flow passages 34A, 34C.

Some alternate arrangements of blocking flanges 74, 76 are now described with reference to FIGS. 14 and 15.

Figure 14:
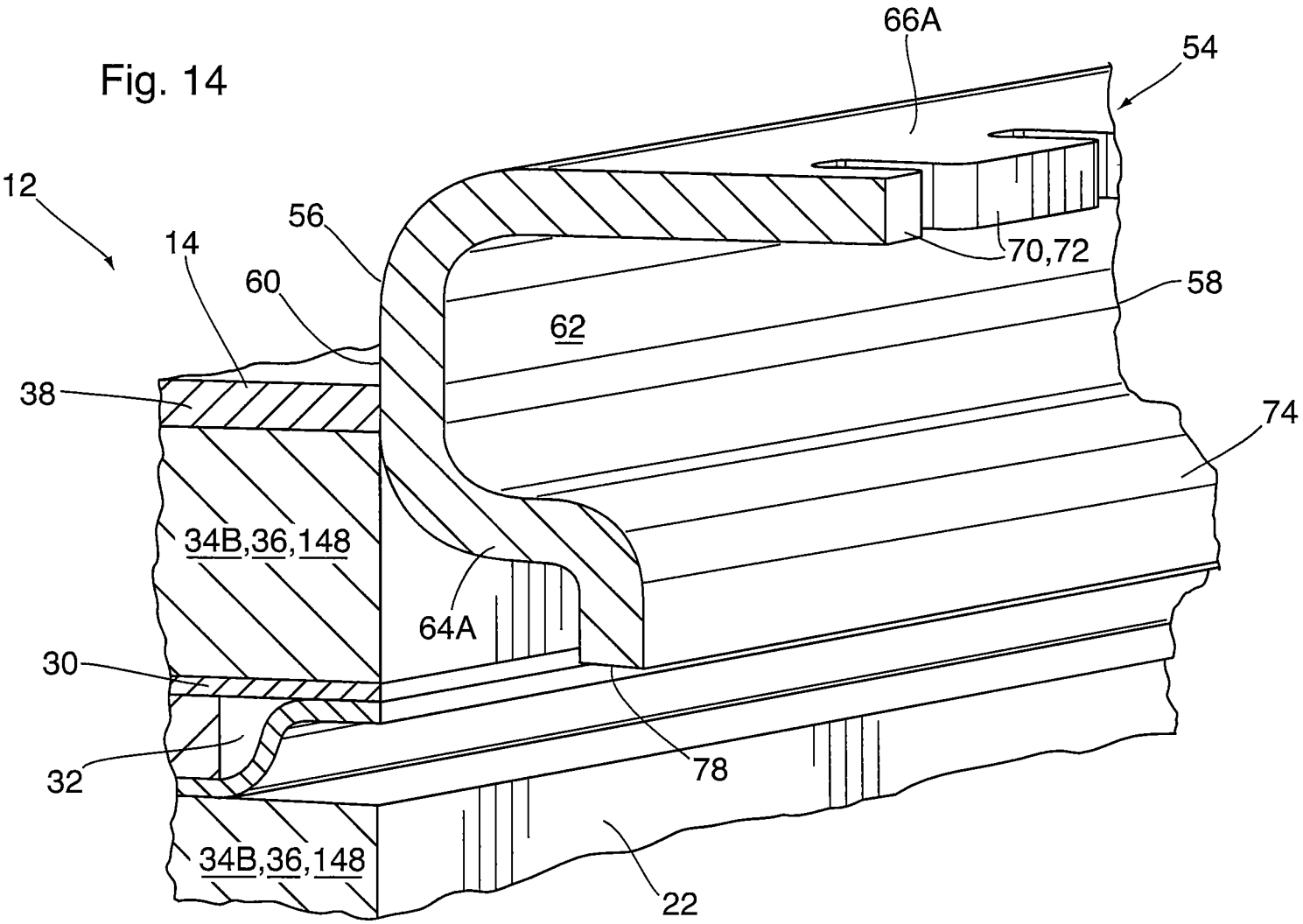
FIG. 14 is a close-up perspective cross-sectional view similar to FIG. 13, showing an alternate blocking flange.

FIG. 14 shows an alternate arrangement where the top blocking flange 74 extends at about 90 degrees from the free end of the inner wall 64, and may extend parallel to the y axis throughout at least part of the height of the uppermost gas flow passage 34A. It will be appreciated that the gap between the blocking flange 74 and the front face 22 or rear face 24 of core 12 will allow some gas flow into gas flow passage 34A. A similar arrangement may be provided for the bottom blocking flange 76.

Figure 15:
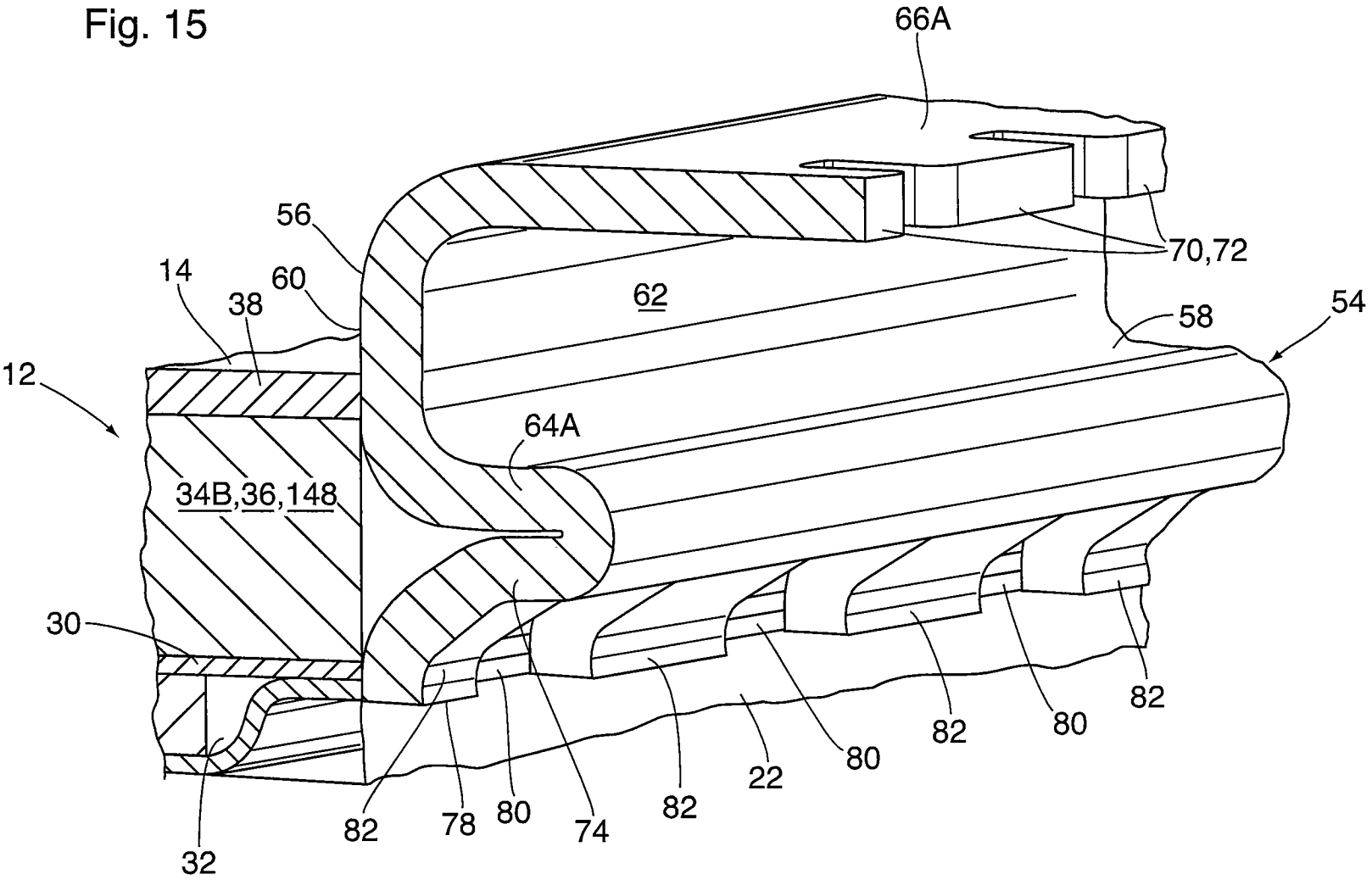
FIG. 15 is a close-up perspective cross-sectional view similar to FIG. 13, showing another alternate blocking flange.

FIG. 15 shows an alternate arrangement where the top blocking flange 74 includes a portion which extends at about 90 degrees from the base of the inner wall 64, this being achieved by bending the inner wall 64 back on itself so that it comprises two layers. According to this arrangement the terminal end 78 of blocking flange 74 may be substantially co-planar with the flat planar surface 60 on the first side 56 of the connecting element 54. According to this embodiment, the blocking flange 74 is provided with a plurality of interruptions 80 in the form of rectangular notches so as to permit some gas flow into the uppermost gas flow passage 34A. A similar arrangement may be provided for the bottom blocking flange 76.

Rather than the rectangular notches shown in FIGS. 13 and 15, the interruptions 80 of blocking flanges 74, 76 may comprise wedge-shaped notches, similar to that shown in FIG. 4, extending from the free end 78 toward the point of attachment to inner wall 64, such that the blocking flanges 74, 76 each define a plurality of spaced apart wedge-shaped tabs 82.

Alternatively, the interruptions 80 in FIGS. 13 and 15 can be replaced by a plurality of discrete openings, such as the slot-shaped and circular interruptions 80 shown in FIG. 4. Similarly, a continuous blocking flange 74, 76 such as that shown in FIG. 14 can be provided with a plurality of interruptions 80 in the form of discrete openings, such as those shown in FIG. 4.

Figure 15A:
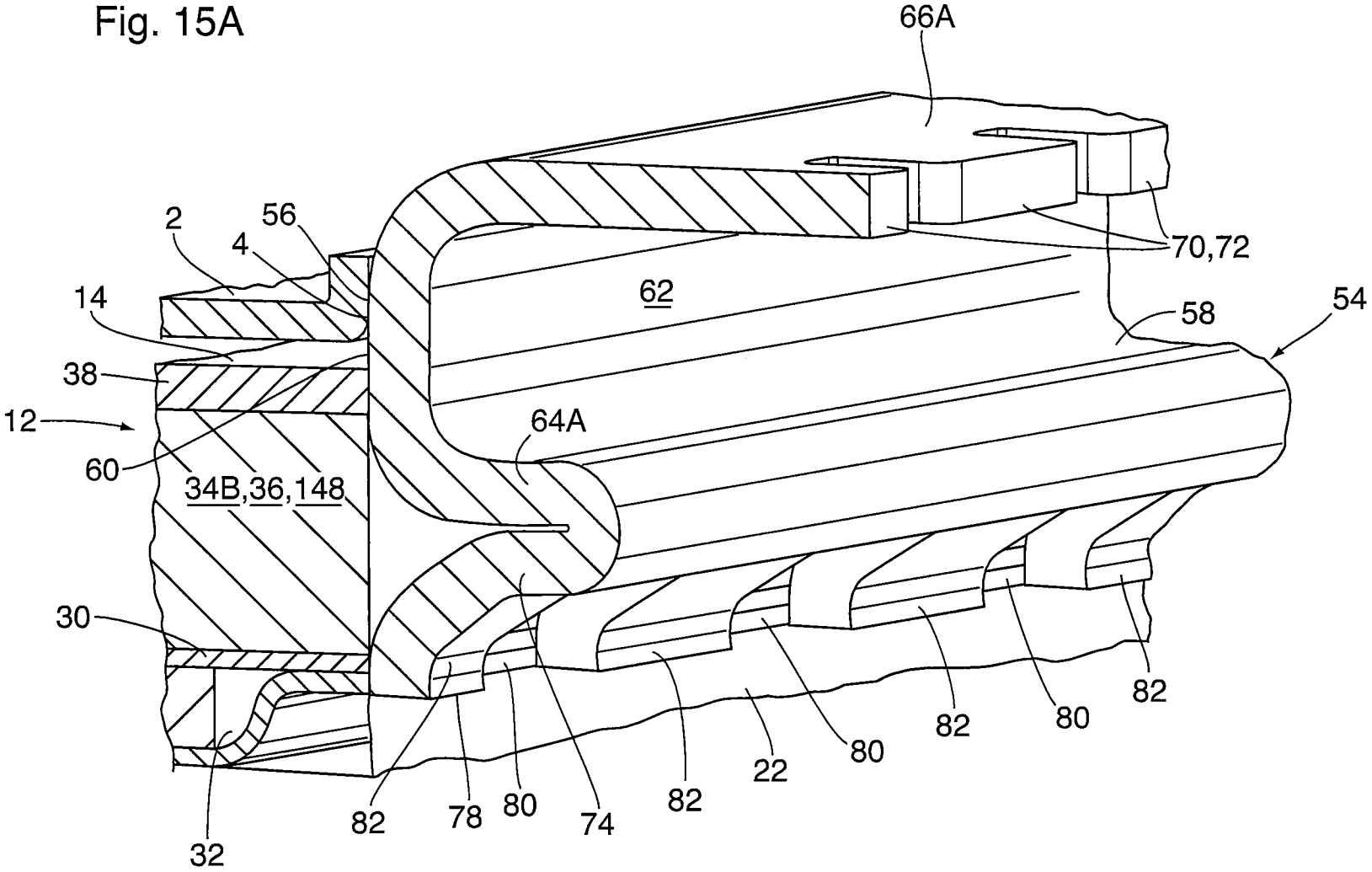
FIG. 15A is a close-up perspective cross-sectional view similar to FIG. 15, showing an alternate construction including a housing.

The embodiments of FIGS. 5-15 relate to heat exchanger constructions which do not include an external housing covering the top 14, bottom 16 and sides 18, 20 of core 12, and in which connecting elements 54 (crimp flanges) for attaching manifold covers 42, 44 are directly attached to the front face 22 and/or rear face 24 of core 12. FIG. 15A shows an alternate embodiment which includes an external housing similar to housing 2 of FIGS. 1 and 2. Although only a portion of the top wall of housing 2 is shown in FIG. 15A, it will be appreciated that the housing 2 will also include a bottom wall and side walls, as in the housing of FIGS. 1 and 2.

In order to permit insertion of the core 12 into the housing 2, the housing 2 may be constructed from two or more components. For example, the housing 2 may be open at one end to permit insertion of the core 12, with at least one of the manifold covers 42, 44 being provided as separate components as shown in FIG. 5. As shown in FIG. 15A, a connecting element 54 is provided in order to secure a manifold cover 42 or 44 to the remainder of housing 2. However, instead of attaching the rear side 56 of connecting element 54 to the core 12, it may be connected to an open end of the housing 2, which may have a connecting face 4 as shown in FIG. 15A, the connecting face extending along the entire peripheral edge of the open end. Typically the connecting element 54 will be attached to the housing 2 by a mechanical connection, and the housing 2 and/or connecting element 54 may include additional elements or otherwise be adapted for providing a mechanical connection.

Although heat exchanger 10 described above includes blocking flanges 74, 76 in the connecting elements 54 to be attached to both the front and rear faces 22, 24 of core 12, it will be appreciated that this is not essential. For example, it is possible to achieve partial or complete blocking of gas flow through the uppermost and lowermost gas flow passages 34A, 34C by providing blocking flanges 74, 76 in only the connecting element 54 attached to the front face 22 or only the connecting element 54 attached to the rear face 24.

The heat exchanger core 12 may also be provided with aerodynamic performance-enhancing features, and the structure of the core of heat exchanger 10 is now described below. It will be appreciated that the features of the core 12 can be incorporated into heat exchanger 10 regardless of whether or not the connecting elements 54 are provided with blocking flanges 74, 76.

Each of the flat tubes 30 included in the core 12 comprises a pair of core plates 84, 86 joined together at their peripheral edges to enclose and define a coolant flow passage 32, and plates 84, 86 are shown in isolation in FIGS. 16 to 22. Accordingly, the flat tubes 30 may sometimes be referred to in the following description as "plate pairs 30". Plate 84 is referred to herein as "first core plate" or "upper plate" in the following discussion, and plate 86 is referred to herein as "second core plate" or "lower plate".

Plates 84 and 86 have the same dimensions, and each is elongated along the z axis, transverse to the gas flow direction (x axis). Each upper plate 84 has generally flat, planar upper and lower surfaces 88, 89, an opposed pair of upturned side edges 94, 96, and a pair of upstanding bosses 98, 100 aligned along the gas flow direction (x axis). The side edges 94, 96 extend along the x axis, i.e. the sides 18, 20 of core 12. The flat upper surfaces of bosses 98, 100 are perforated to define respective coolant manifold openings 102, 104. Between the bosses 98 is a transversely extending, upstanding flap or tab 106, the function of which will be discussed below. The upstanding flap 106 is formed by slitting the upper plate 84 to form three sides of the flap 106, and folding the flap 106 upwardly along the fourth side which remains attached to the remainder of plate 84, thereby leaving a hole 108 in the plate 84 having the shape of the flap 106.

Each lower plate 86 has a upstanding peripheral sealing flange 110 surrounding a generally flat planar central portion 112 having an upper surface 90 and a lower surface 92, an opposed pair of upturned side edges 114, 116, and a pair of depressed bosses 118, 120 aligned along the gas flow direction (x axis). The side edges 114, 116 extend along the x axis, i.e. the sides 18, 20 of core 12. The flat lower surfaces of bosses 118, 120 are perforated to define respective coolant manifold openings 122, 124. The lower plate 86 also has a flow separation rib 126 located between the depressed bosses 118, 120 and extending transversely (along the z axis) toward the upturned side edges 114, 116. The flow separation rib 126 has opposed terminal ends 128, 130 which are spaced from the upturned side edges 114, 116 to define flow-through gaps 132, 134. The flow separation rib 126 has an upper sealing surface 136 which is co-planar with the peripheral sealing flange 110. In addition, the central portion of flow separation rib 126 includes a widened portion 138.

Figure 16:
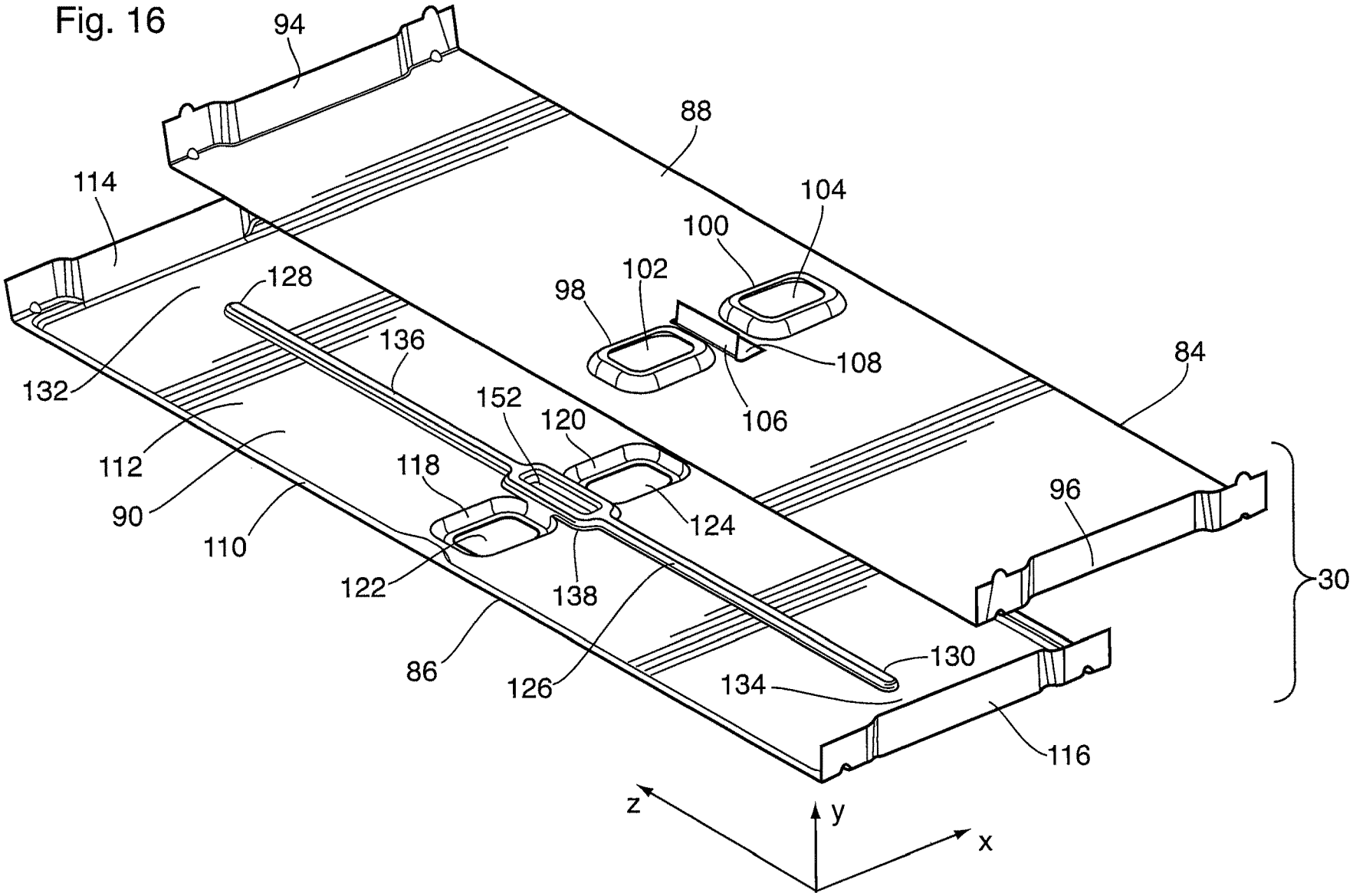
FIG. 16 is a top perspective view showing upper and lower core plates of the heat exchanger of FIG. 5, in isolation.
Figure 17:
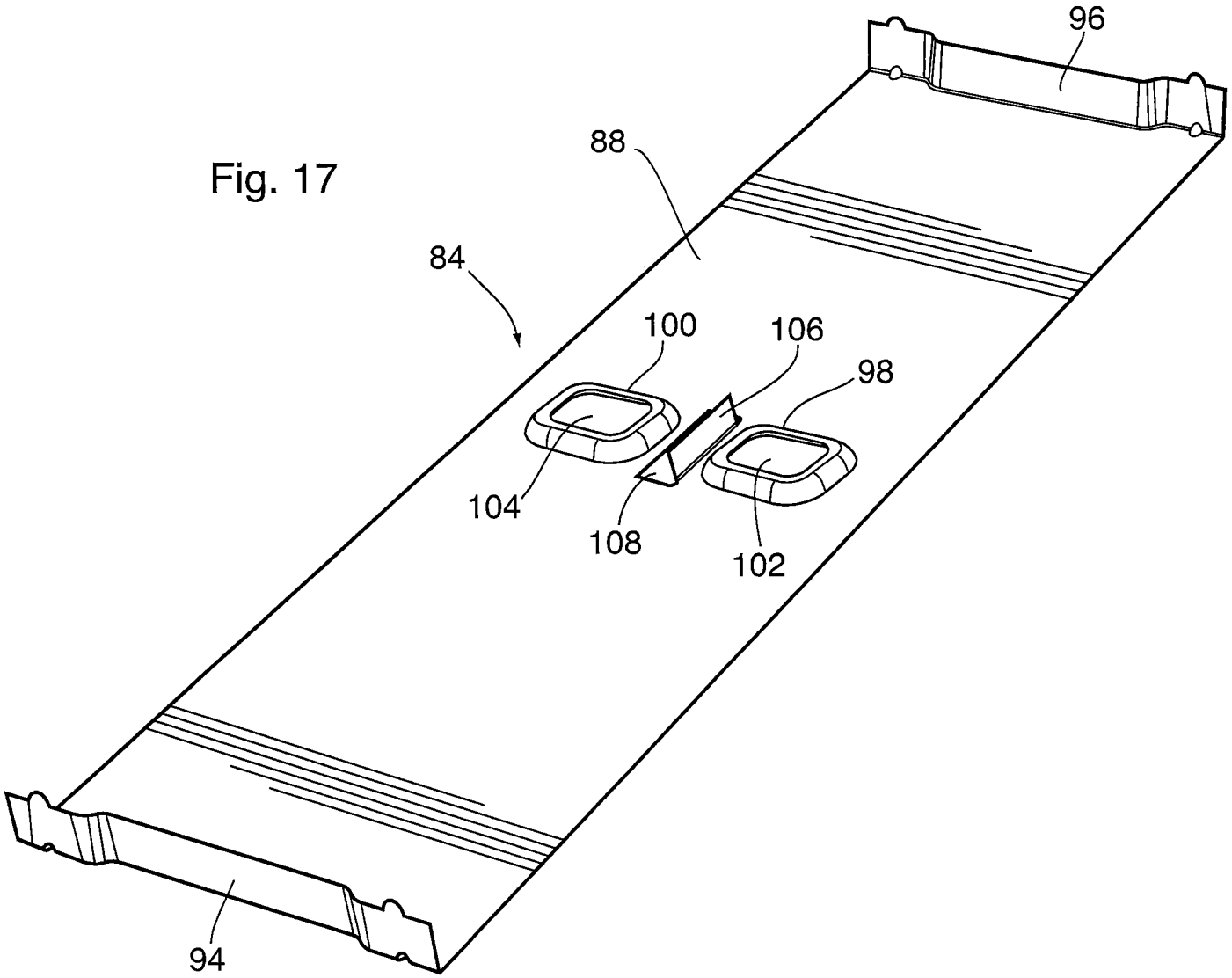
FIG. 17 is a top perspective view of the upper core plate.
Figure 18:
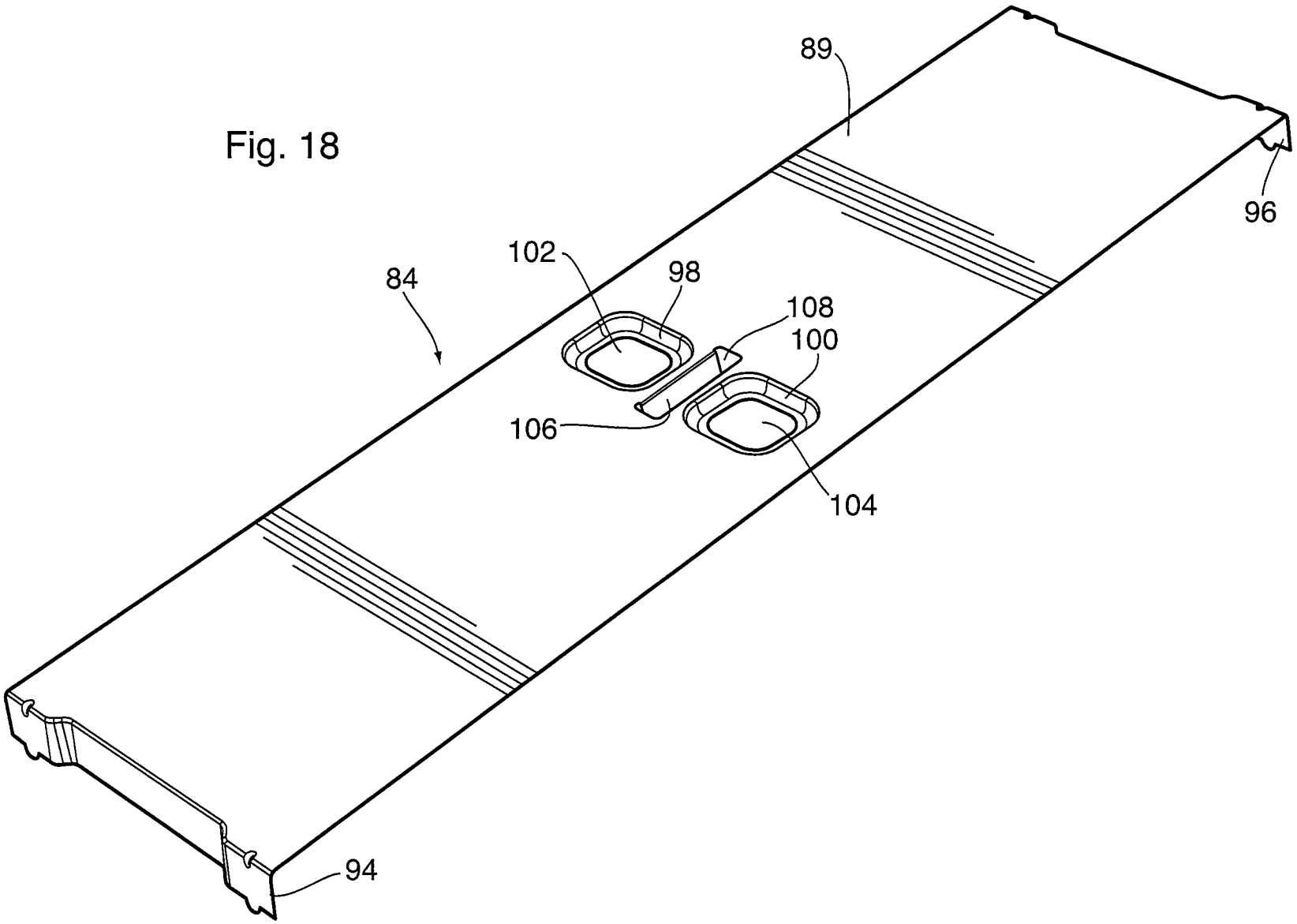
FIG. 18 is a bottom perspective view of the upper core plate.
Figure 19:
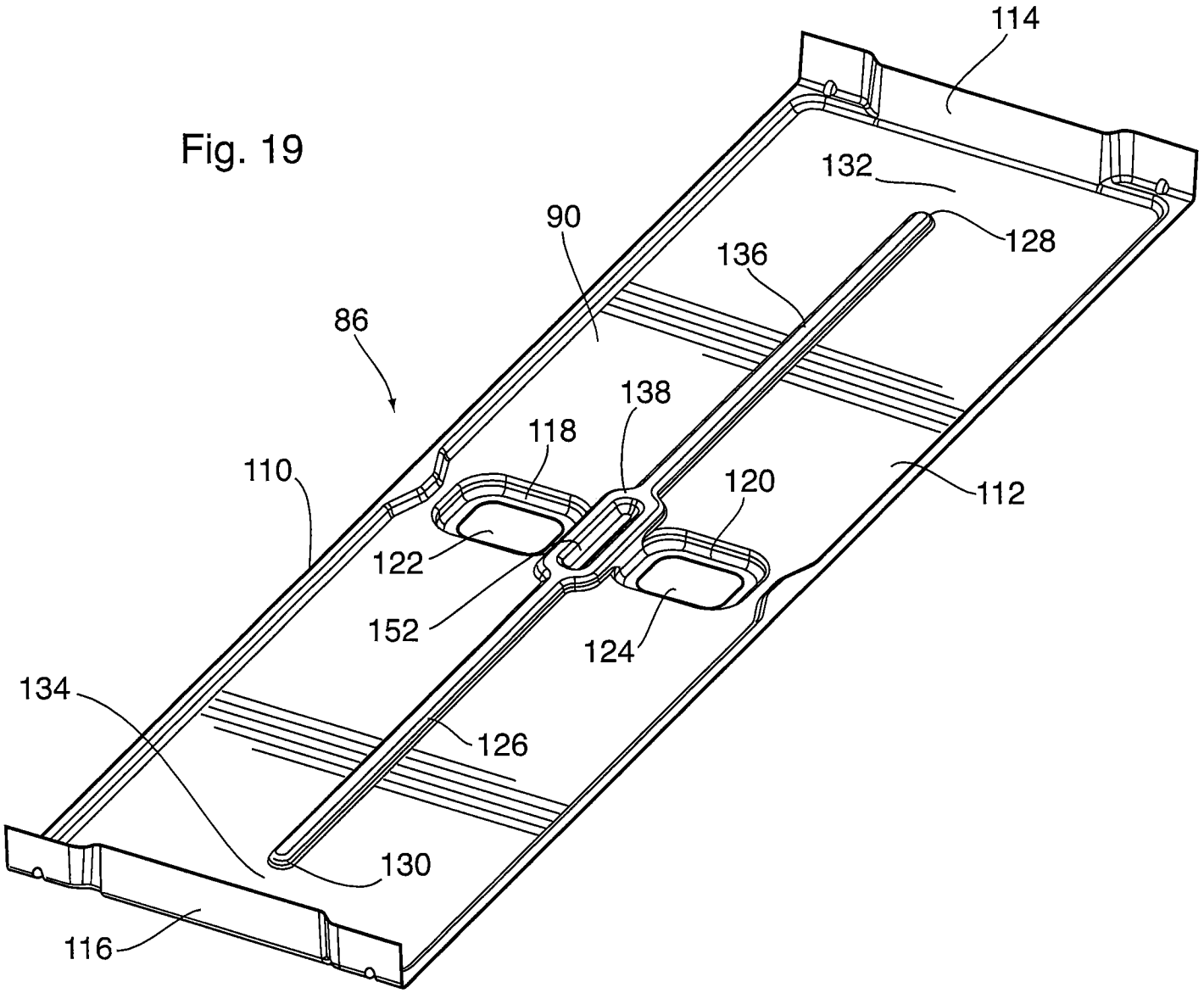
FIG. 19 is a top perspective view of the lower core plate.
Figure 20:
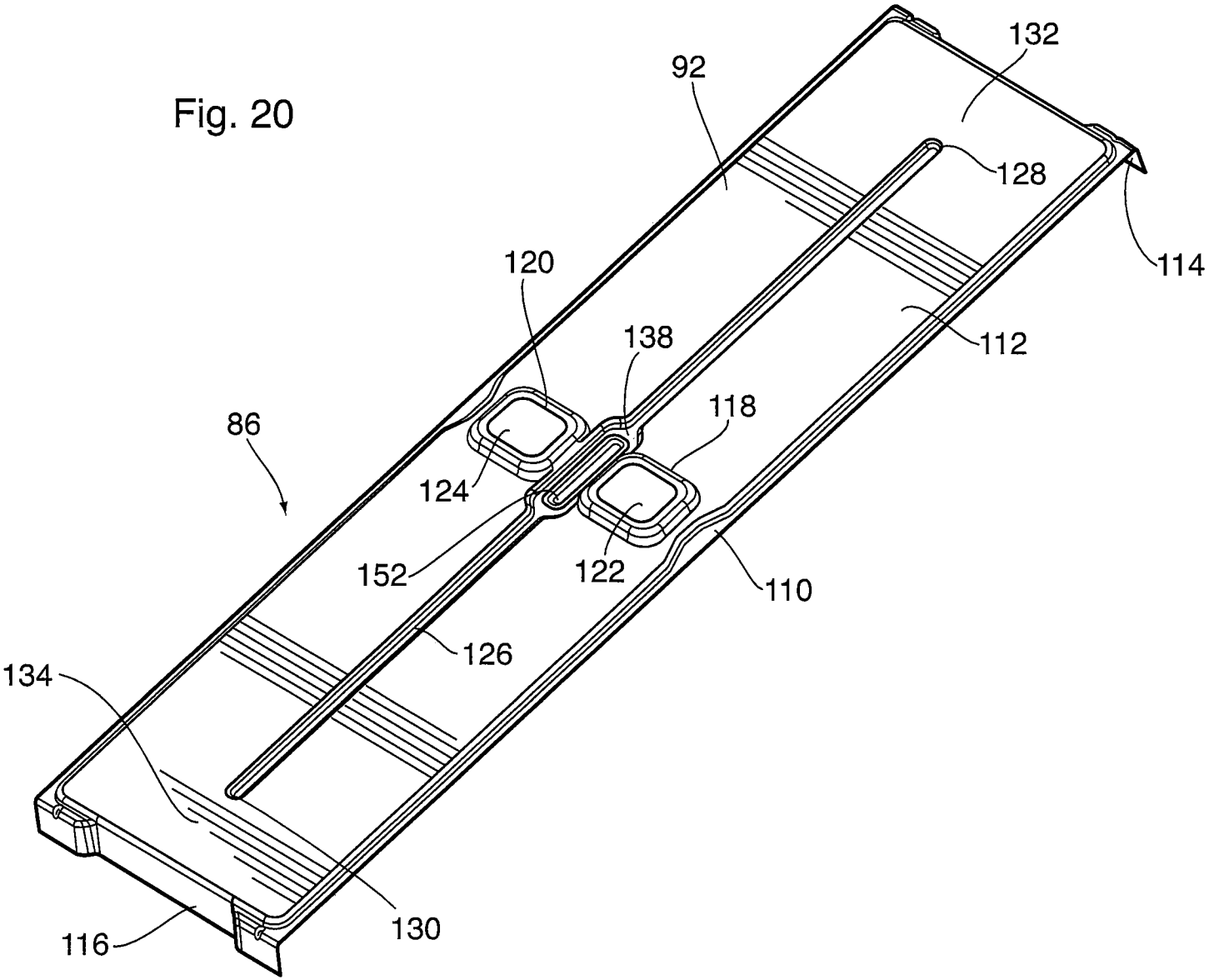
FIG. 20 is a bottom perspective view of the lower core plate.
Figure 21:
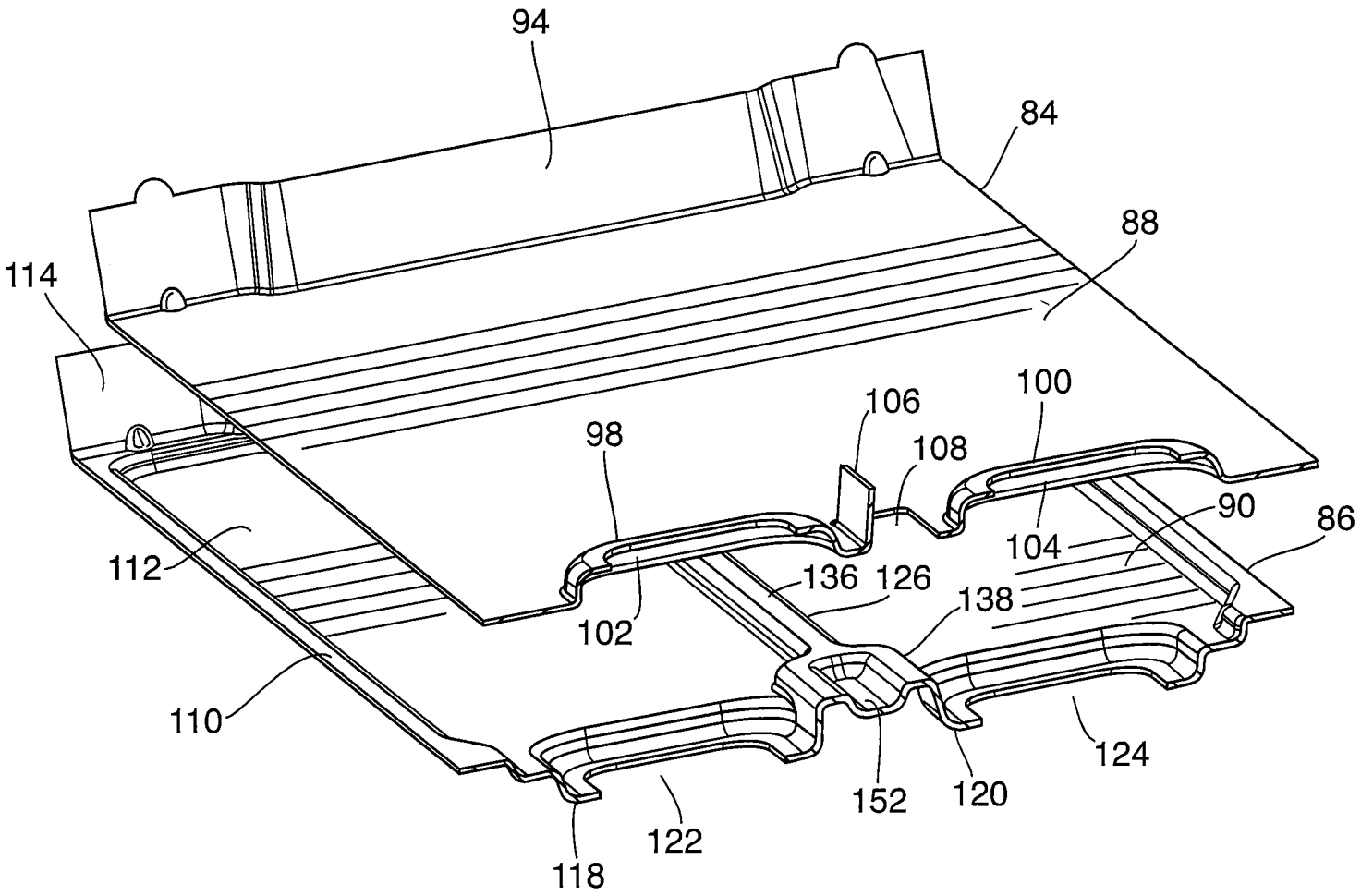
FIG. 21 is an enlarged, partial cross-section through the bosses of the core plates shown in FIG. 16.

A tube 30 of heat exchanger core 12 is formed by coupling together (e.g. by brazing) an upper plate 84 and a lower plate 86 in the orientation shown in FIG. 16, such that the peripheral flange 110 of the second plate 86 is sealed to the lower surface 89 of the upper plate 84. In addition, the upturned side edges 94, 96 of the upper plate 84 become nested inside, and sealed to, the upturned side edges 114, 116 of the lower plate 86, wherein the side edges 94, 96, 114, 116 are slightly angled outwardly (i.e. angled relative to y axis) to allow this nesting.

When the upper and lower plates 84, 86 are coupled together, the upper sealing surface 136 of the flow separation rib 126 of the lower plate 86 sealingly engages the lower surface 89 of the upper plate 84. In this regard, the widened portion 138 of the flow separation rib 126 has sufficient length (along the z axis) and width (along the x axis) so as to surround and sealingly engage the periphery of the hole 108 from which the flap 106 in upper plate 84 is formed. In addition, the coolant manifold openings 102, 104 in the upper plate 84 are aligned with the respective coolant manifold openings 122, 124 in the lower plate 86.

Each coolant flow passage 32 is defined between the upper surface 90 of a lower plate 86 and the lower surface 89 of an upper plate 84 comprising one of the tubes 30, and is enclosed by the sealed peripheral edges of the plates 84, 86. Fluid inlet and outlet openings of each coolant flow passage 32 are defined by the aligned pairs of coolant manifold openings 102, 122 and 104, 124, wherein the coolant enters the fluid flow passage 32 through one pair of aligned openings 102, 122 or 104, 124, and flows outwardly therefrom in opposite transverse directions past the terminal ends 128, 130 of rib 126, changing direction in the gaps 132, 134, and flowing back toward the other aligned pair of coolant manifold openings 102, 122 or 104, 124 on the opposite side of rib 126. Therefore, the coolant in each coolant flow passage 32 follows a pair of opposed U-shaped loops.

Figure 23:
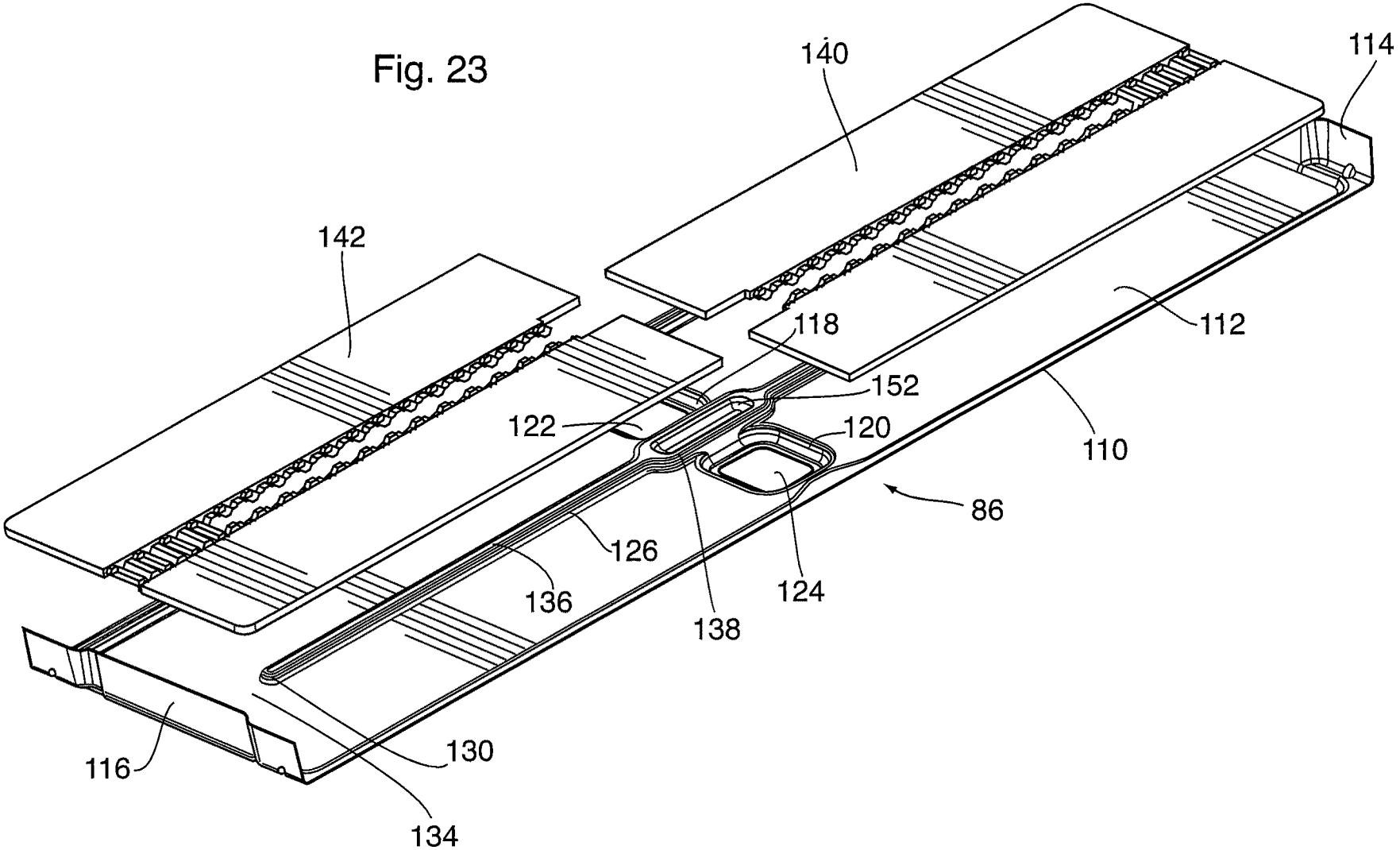
FIG. 23 shows the flow-enhancing inserts which may be provided between the plates shown in FIGS. 16-22.

Each of the U-shaped loops defining the coolant flow passage 32 may be provided with turbulence-enhancing inserts 140, 142, which are schematically shown in FIG. 23 as U-shaped sheets. The turbulence-enhancing inserts 140, 142 comprise corrugated fins or turbulizers and provide increased turbulence and surface area for heat transfer, as well as structural support for the core 12. In this regard, the top and bottom surfaces of the inserts 140, 142 are in contact with, and may be brazed to, the upper and lower plates 84, 86. In the illustrated embodiment, the turbulence-enhancing inserts 140, 142 in coolant flow passage 32 comprise turbulizers having a plurality of transversely extending (along z axis) rows of corrugations.

The core 12 comprises a plurality of plate pairs or tubes 30 stacked on top of each other along the y axis. The number of tubes 30 in the stack is variable, and can vary from one application to another depending on the heat transfer requirements. Adjacent tubes 30 in the stack are sealingly secured to one another along the side edges, wherein the nested pair of upturned side edges 94, 114 of one tube 30 is in sealed engagement with, and partially nested with, the corresponding pair of upturned side edges 94, 114 of an adjacent tube 30. Similarly, the nested pair of upturned side edges 96, 116 on the opposite sides of the tubes 30 are also in sealed, partially nested engagement with each other. It can be seen that the sealed engagement and nesting of upturned side edges 94, 114 and 96, 116 throughout the height of the stack will completely enclose the sides 18, 20 of core 12, thereby eliminating the need for an external housing to cover the sides 18, 20.

In addition, each of the tubes 30 has a pair of bosses 98, 100 extending from its upper surface and a pair of bosses 118, 120 extending from its lower surface. When the tubes 30 are stacked, the flat upper surfaces of the upstanding bosses 98, 100 of one tube 30 are sealingly engaged to the flat lower surfaces of depressed bosses 118, 120 of an adjacent tube 30. Accordingly, the coolant manifold openings 102, 122 are aligned throughout the stack of tubes 30 to form a first coolant manifold 144, and similarly the coolant manifold openings 104, 124 are aligned throughout the stack of tubes 30 to form a second coolant manifold 146, wherein each of the first and second coolant manifolds 144, 146 functions as either the coolant inlet manifold or the coolant outlet manifold.

The gas flow passages 34 defined by the spaces between adjacent tubes 30 are provided with a turbulence-enhancing insert 36. The insert 36 may be a simple corrugated fin comprising a plurality of parallel corrugations extending parallel to the gas flow direction (x axis). The corrugations may be defined by substantially vertical side walls which are arranged in spaced parallel relation to one another, with adjacent side walls being joined together along crests and valleys, wherein the crests and valleys are in thermal contact with the adjacent tubes 30, and may be brazed thereto. For example, the turbulence-enhancing insert 36 may have substantially vertical side walls which are free of perforations, and rounded crests and valleys. However, it will be appreciated that the side walls may be inclined relative to one another, the side walls may be perforated for example by louvers, and/or the crests and valleys may be angular.

In the illustrated embodiment, the coolant manifolds 144, 146 are centrally located in core 12. Therefore, turbulence-enhancing insert 36 comprises two sections 148, 150, as can be seen in the transverse cross section of FIGS. 5 and 6. Section 148 of insert 36 consists of a rectangular sheet which substantially completely fills the space between the manifolds 144, 146 and the nested side edges 94, 114; and section 150 of insert 36 substantially completely fills the space between manifolds 144, 146 and nested side edges 96, 116. Both sections 148, 150 of insert 36 extend along the x axis along substantially the entire lengths of the tubes 30.

It will be appreciated that bypass flow of gas through the space between insert sections 148, 150 along the gas flow direction (x axis) will largely be blocked by the coolant manifolds 144, 146. However, due at least partly to the sloped sides of bosses 98, 100, 118, 120, some of the gas flow will pass through the small gaps between the manifolds 144, 146 and the adjacent insert sections 148, 150, reducing efficiency of the heat exchanger 10. Due to manufacturing tolerances, it is difficult to completely close this gap. Also, depending on the temperature of the incoming gas flow, it is possible that contact between the hot incoming gas and the coolant manifold 144 or 146 closest to the inlet may cause boiling of the coolant inside the manifold 144 or 146, which should be avoided.

Figure 22:
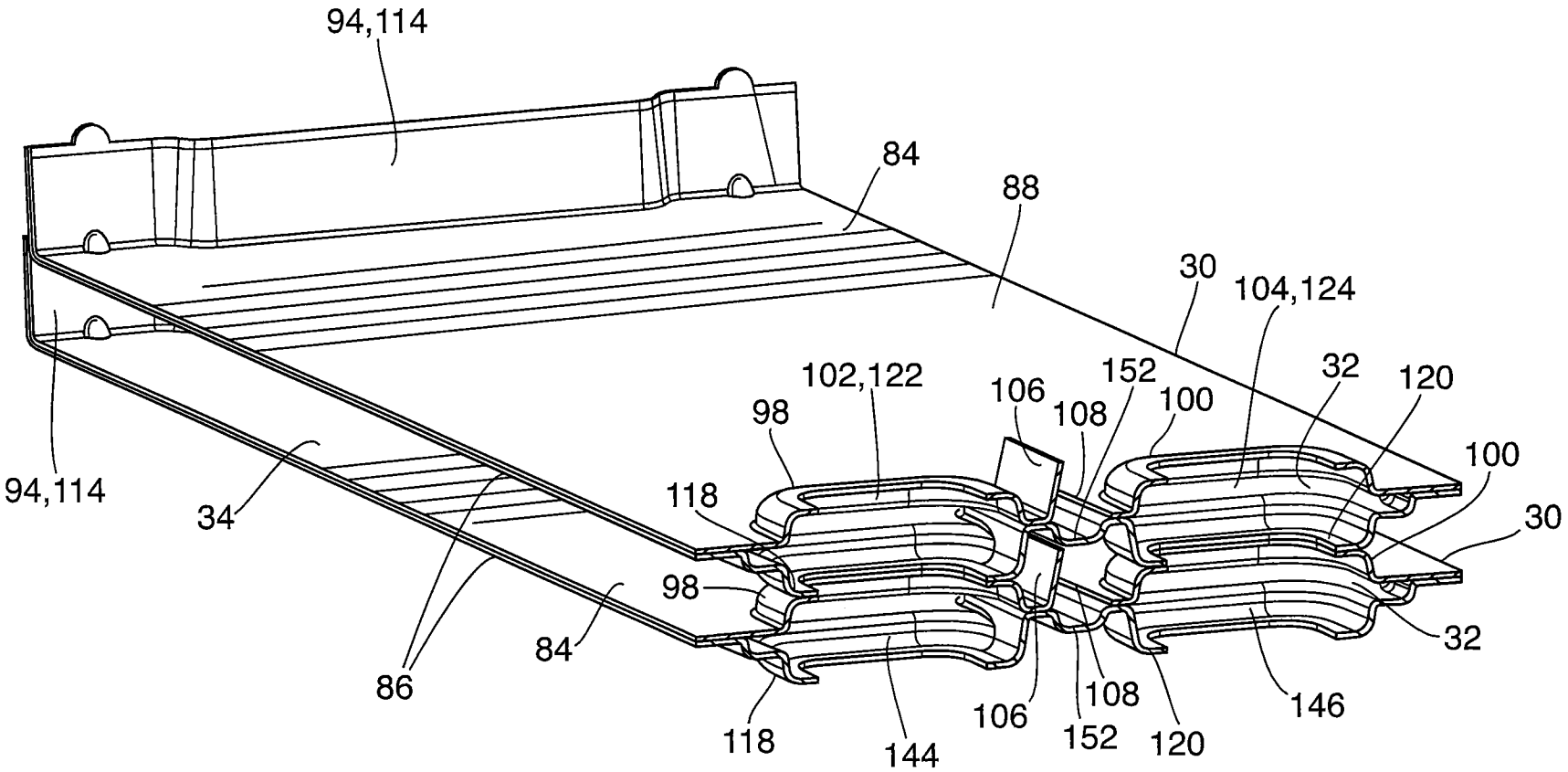
FIG. 22 is a view similar to that of FIG. 21, showing two adjacent plate pairs comprising the core plates shown in FIG. 16.

The presence of the flap 106 addresses these concerns by at least partially blocking gas flow through the core 12 in the vicinity of the manifolds 144, 146, including the small gaps surrounding the edges of the manifolds 144, 146. In this regard, the flap 106 has a transverse length (along z axis) which is substantially the same width as the bases of the bosses 98, 100, 118, 120, and substantially the same as the gap between the inserts 148, 150. The flap 106 has a height (along y axis) sufficient that the free end of flap 106 engages or is in close proximity to the upwardly adjacent tube 30. As shown in FIG. 22, the widened portion 138 of the flow separation rib 126 may be formed with a downwardly extending trough 152 to minimize a gap between the free edge of flap 106 and the upwardly adjacent tube 30.

The top plate 38 and bottom plate 40 have the same dimensions as the core plates 84, 86, and each is elongated along the z axis, transverse to the gas flow direction (x axis). These plates are now described below with reference to FIGS. 24 and 25.

Figure 25:
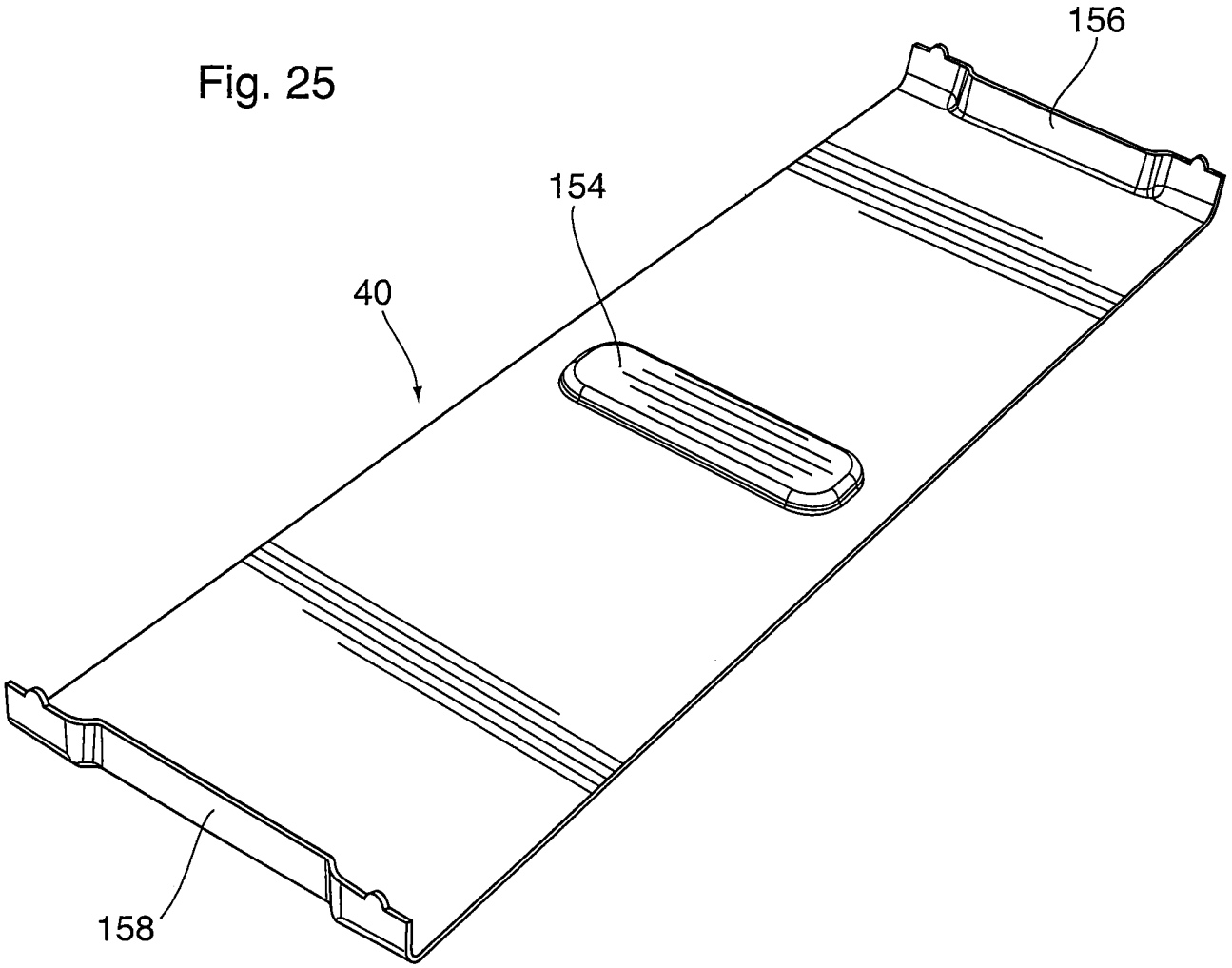
FIG. 25 is a top perspective view of the bottom plate of the heat exchanger of FIG. 5.

The bottom plate 40 is shown in FIG. 25 and has upper and lower surfaces which are generally flat and planar, except that an upstanding boss 154 extends upwardly from the upper surface and has a flat top which is free of perforations. The flat top is sized and shaped to sealingly engage the depressed bosses 118, 120 of the lowermost tube 30 in the core 12. Therefore the upstanding boss 154 of the bottom plate 40 seals the bottoms of both coolant manifolds 144, 146, as can be seen in FIG. 7.

The bottom plate 40 also has a pair of upturned side edges 156, 158 extending along the x axis, i.e. the sides 18, 20 of core 12. In the assembled core 12, the upturned side edges 94, 114 of the lowermost tube 30 become nested inside, and sealed to, the upturned side edge 156 of bottom plate 40, while the upturned side edges 96, 116 of the lowermost tube 30 become nested inside, and sealed to, the upturned side edge 158. The upturned side edges 156, 158 have the same configuration as those of core plates 84, 86 described above, and are slightly angled outwardly (i.e. angled relative to y axis) to allow nesting.

It will be seen that the lowermost gas flow passage 34C is located between the bottom plate 40 and the lowermost tube 30, and is provided with a turbulence-enhancing insert 36 comprising sections 148, 150, as already described above. The bottom plate 40 lacks a flap analogous to flap 106 described above.

Figure 24:
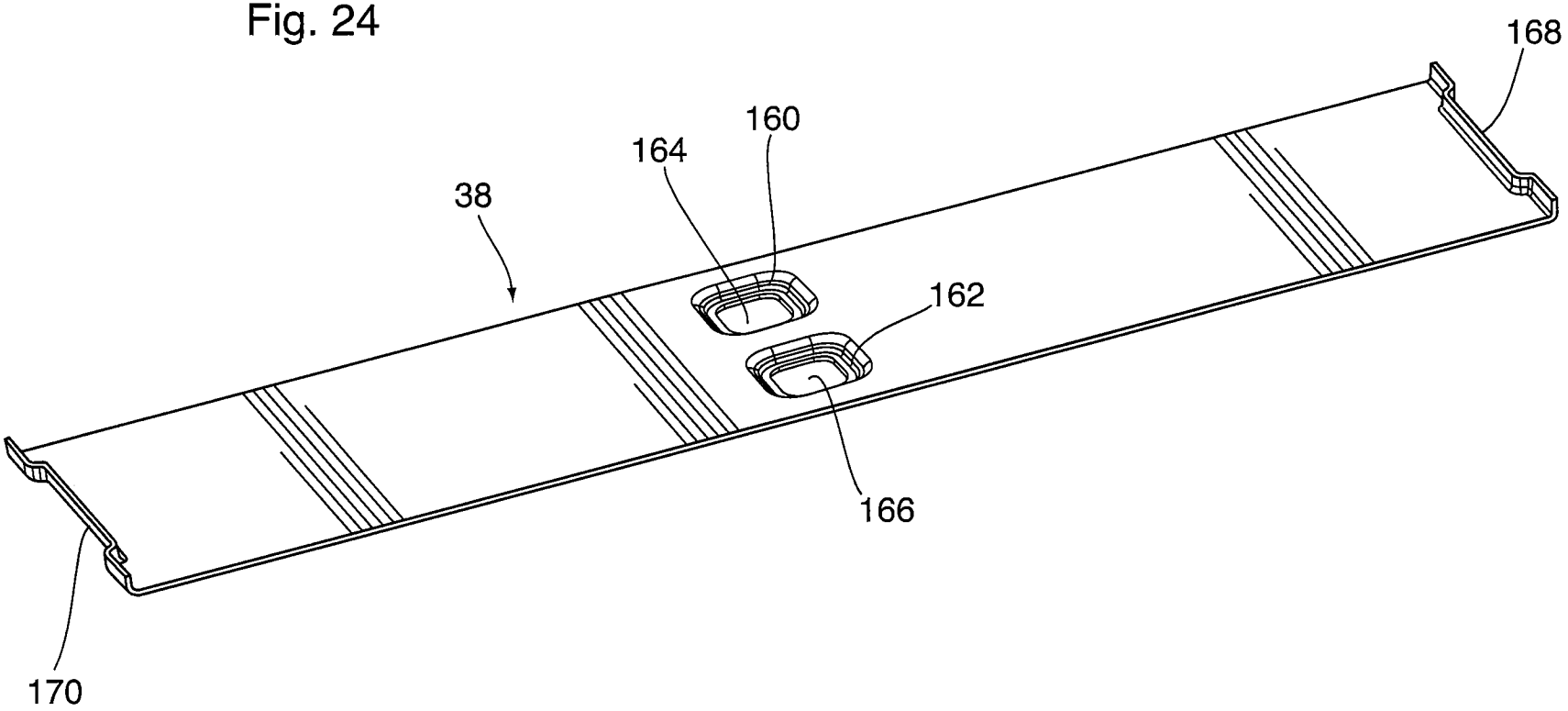
FIG. 24 is a top perspective view of the top plate of the heat exchanger of FIG. 5.

The top plate 38 is shown in FIG. 24 and has upper and lower surfaces which are generally flat and planar, except that a pair of depressed bosses 160, 162 extends downwardly from the bottom surface. The depressed bosses 160, 162 are aligned along the gas flow direction (x axis) and are provided with coolant ports 164, 166. The top plate 38 has a pair of upturned side edges 168, 170 which, in the assembled core 12, become nested inside and sealed to the upturned side edges of the uppermost tube 30 in core 12. More specifically, side edge 168 of top plate 38 is nested in the upturned side edges 94, 114 of the uppermost tube 30, while side edge 170 is nested in the upturned side edges 96, 116 of uppermost tube 30. The upturned side edges 168, 170 have the same configuration as those of core plates 84, 86 described above, and are slightly angled outwardly (i.e. angled relative to y axis) to allow nesting.

The depressed bosses 160, 162 of top plate 38 have flat lower surfaces surrounding ports 164, 166 which, in the assembled core 12, sealingly engage the upstanding bosses 98, 100 of the uppermost tube 30, such that the tops of the coolant manifolds 144, 146 are open. This arrangement is also shown in FIG. 7.

As mentioned above, the heat exchanger 10 includes coolant fittings 18, 20 which sealingly engage the peripheral edges of the depressed bosses 160, 162 along the upper surface of top plate 38, thereby providing sealed communication with the coolant manifolds 144, 146. The fittings 18, 20 may optionally be mounted to the top plate 38 through an intermediate sealing plate 172, shown in FIGS. 5-7.

It will be seen that the uppermost gas flow passage 34A is located between the top plate 38 and the uppermost tube 30, and is provided with a turbulence-enhancing insert 36 comprising sections 148, 150, as already described above. The flap 106 protruding from the uppermost tube 30 protrudes into the space between the bosses 160, 162 of the top plate 38, with the free end of flap 106 in close proximity to top plate 38. This arrangement is also shown in FIG. 7.

The top and bottom plates 38, 40 seal the top and bottom of the core 10, thereby reducing or eliminating the need for an external housing over the top and bottom 14, 16 of core 12.

In operation of heat exchanger 10, a hot gas such as air is caused to flow along the x axis through the gas flow passages 34 of core 12, between the gas openings 48 of manifold covers 42, 44. Assuming that fitting 18 is the coolant inlet and fitting 20 is the outlet, a liquid coolant will enter the core 12 through fitting 18 and will enter coolant manifold 144. From there, the coolant flows through all the coolant flow passages 32 in crossflow configuration with the hot gas, and absorbs heat from the hot gas. The coolant then flows to the other coolant manifold 146 and exits the heat exchanger through outlet fitting 20.

Heat exchangers having alternate core plate configurations are now described below.

Figure 26:
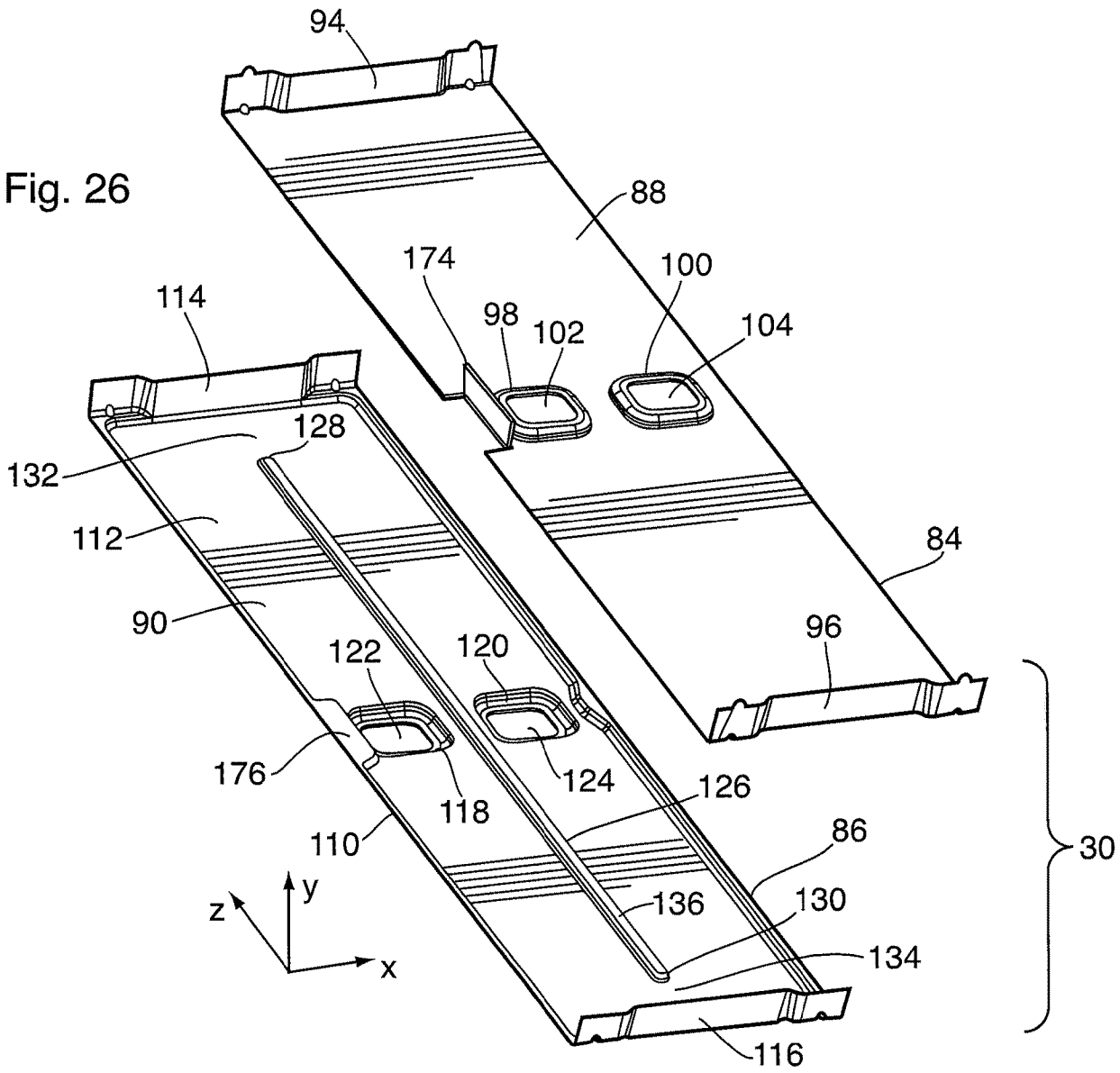
FIG. 26 is a top perspective view showing upper and lower core plates of a heat exchanger according to an alternate embodiment.

FIG. 26 shows an alternate form of upper and lower core plates 84, 86 which can be used to construct a coolant tube 30 in a heat exchanger similar to heat exchangers 1 and 10 described above. The upper core plate 84 in FIG. 26 does not have a bypass blocking flap 106 between the upstanding bosses 98, 100 of upper plate 84, but instead has a bypass blocking flap 174 located between an edge of the upper plate 84 and one of the bosses 98 or 100, so that the bypass blocking flap 174 will be proximate to the front or rear face 22, 24 of the assembled heat exchanger core 12. The flap 174 may be formed at the edge of the plate 84, as shown, by forming two parallel slits and bending the flap 174 upwardly. The lower core plate 86 is modified by providing the peripheral flange 110 with a widened area 176 which sealingly engages the upper plate 84 in the area surrounding the hole or notch which results from the formation of flap 174. It will be appreciated that the flow separation rib 126 may have a constant width in this embodiment, and does not need a widened portion. The free end of the flap 174 may engage or be in close proximity to the bottom surface of the upwardly adjacent tube 30 or top plate 38 proximate to the front or rear face 22, 24 of core 12. If desired, flaps 174 may be provided along both the front and rear faces 22, 24 of core 12. Aside from the differences noted above, the upper and lower core plates 84, 86 of FIG. 26 are identical to the core plates 84, 86 of heat exchanger 10 described above, and can be incorporated into a heat exchanger core 12 and heat exchanger in the same manner as core plates 84, 86 described above.

Figure 27:
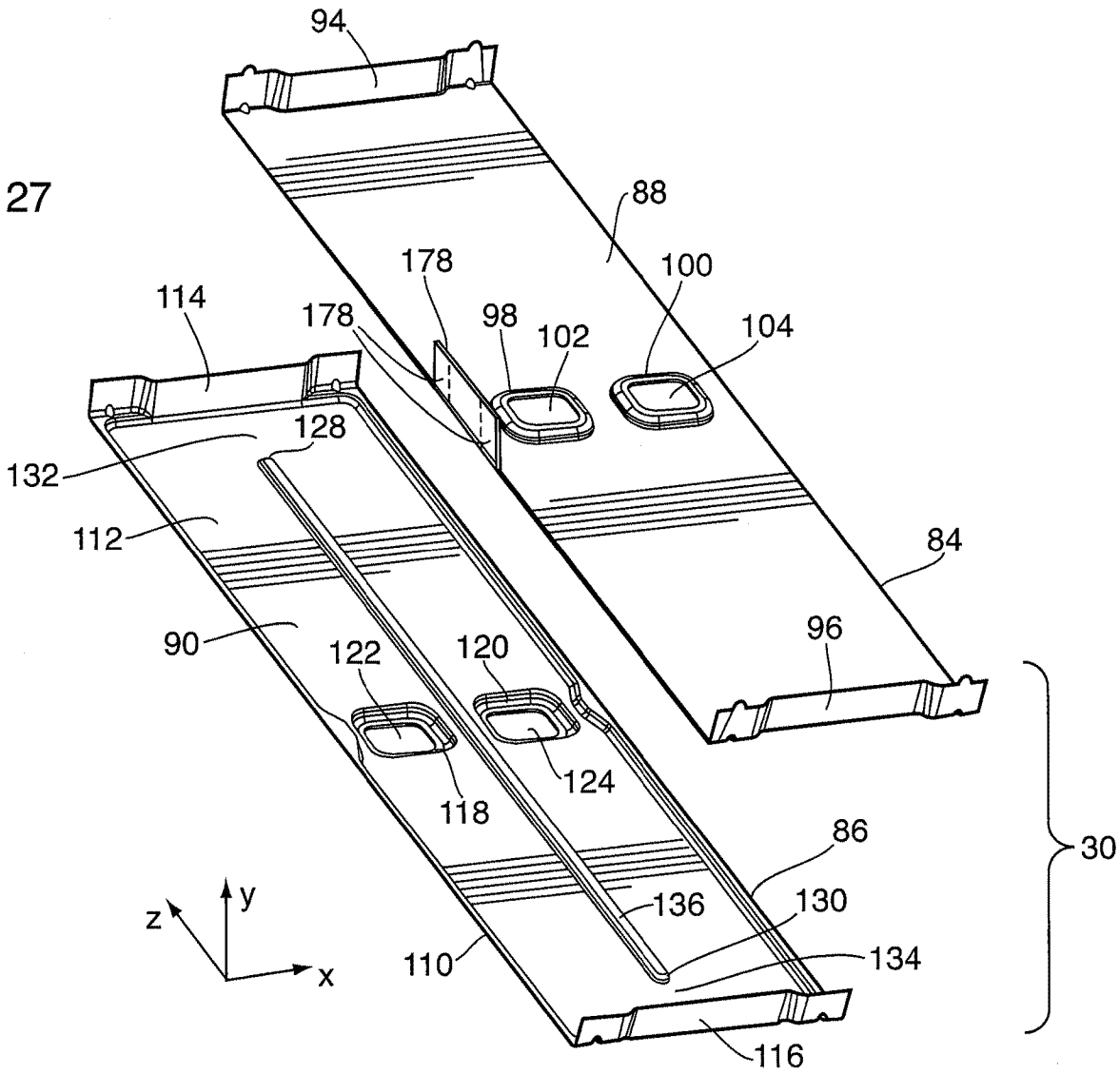
FIG. 27 is a top perspective view showing upper and lower core plates of a heat exchanger according to another alternate embodiment.
Figure 27A:
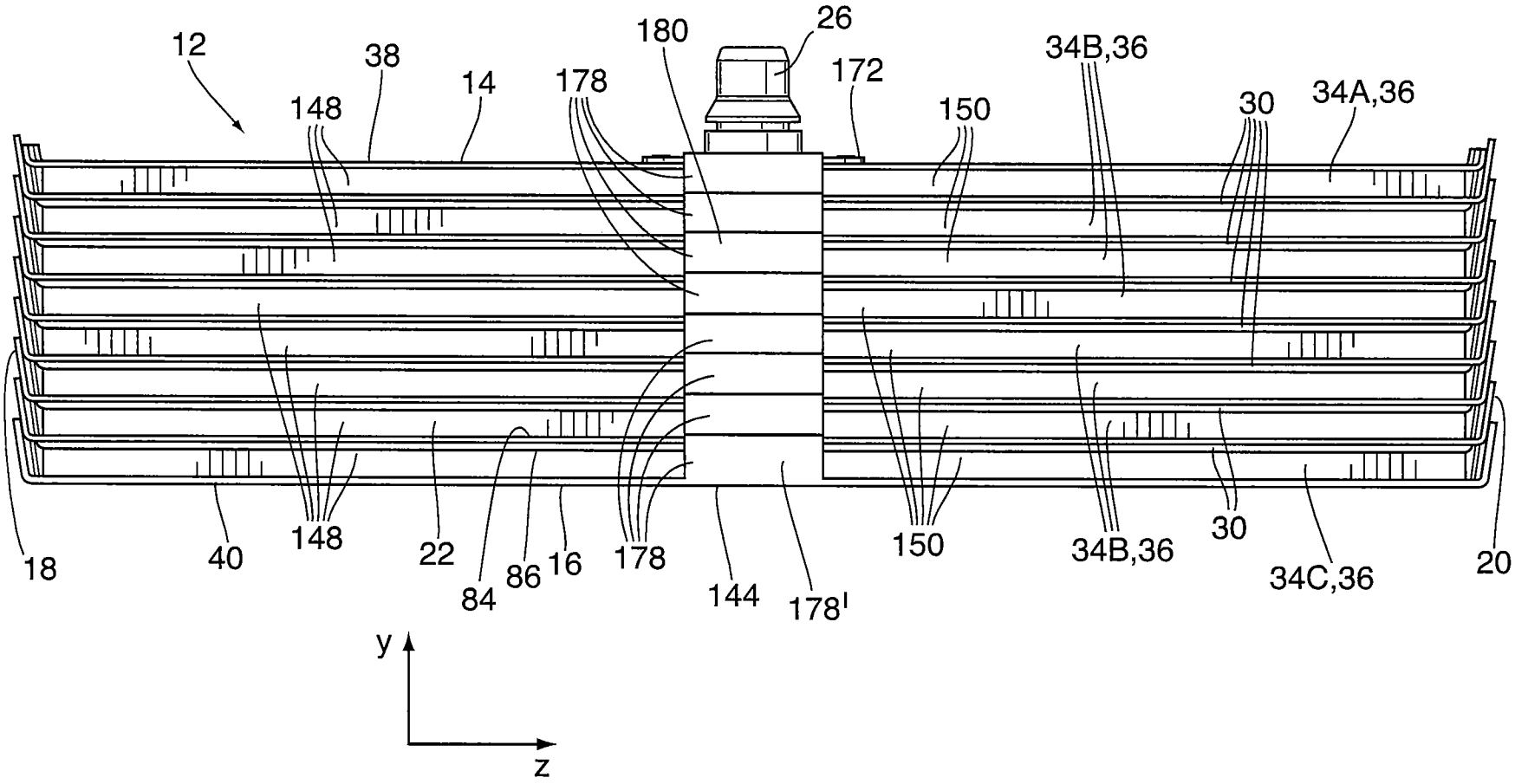
FIG. 27A is a front elevation view of the core of the heat exchanger according to the embodiment of FIG. 27.

FIGS. 27 and 27A show another alternate form of upper and lower core plates 84, 86 in which a bypass blocking flap 178 is incorporated at least one of the edges of upper core plate 84 which will lie along the front face 22 or the rear face 24 of core 12. In the present embodiment, the flap 178 is formed as a tab projecting from a front edge of the upper plate 84, and is folded upwardly along a fold line which is collinear with the front edge of the plate 84. This embodiment is advantageous in that the flap 178 can have a height (along y axis) such that it will nest with and sealingly engage with the upwardly projecting flaps 178 of adjacent tubes 30 in the core 12, thereby forming a continuous bypass blocking element 180 throughout the height of the core 12, as shown in FIG. 27A. For example, the flap 178 may have the same or similar height as the upturned sides 94, 96 of core plate 84, and may also be slightly inclined outwardly so as to improve nesting with the flaps 178 of adjacent tubes 30. Also, because the flap 178 will be positioned in front of or behind the sections 148, 150 of turbulence-enhancing insert 36, it does not need to fit inside the gap between sections 148, 150. Therefore, the length of the flap 178 (along the z axis) may be increased to overlap the edges of the sections 148, 150 of turbulence-enhancing insert 36 along the front face 22 and/or rear face 24 of the core 12, so as to more completely block any gap between manifolds 144, 146 and the turbulizer sections 148, 150. As shown in FIG. 27A, the bottom plate 40 of the core 12 may also be provided with an upwardly projecting flap 178' which nests with the flap 178 of an upwardly adjacent core plate 84. When the core 12 is provided with nested flaps 178 along its front face 22, it will be appreciated that direct contact of the hot incoming gas with the coolant manifold 144 closest to front face 22 will be effectively blocked by the nested flaps 178, thereby effectively preventing boiling of the coolant in the coolant manifolds 144, 146. Instead of forming the continuous bypass blocking element 180 from nested flaps 178, it will be appreciated that it can be formed from a single piece of metal which is applied to the front face 22 or rear face 24 of core 12, for example by welding.

Because the flap 178 is provided to cover relatively narrow bypass channels on either side of bosses 98, 100, 118, 120, it is possible to replace the single elongate flap 178 by a pair of shorter flaps 178' (i.e. shorter along the z axis), each flap 178' being wide enough to cover a bypass channel on one side of the bosses. Dotted lines in FIG. 27 show the approximate dimensions of shorter flaps 178'.

In the embodiment of FIG. 27, the bottom plate 86 can be identical to the bottom plate 86 described above, except the flow separation rib 126 can be of constant width. Also, it will be appreciated that the tab from which each flap 178 is formed can be provided in the bottom plate 86 instead of top plate 84, or both the top and bottom plates 84, 86 can be provided with flaps 178. Aside from the differences noted above, the upper and lower core plates 84, 86 of FIG. 27 are identical to the core plates 84, 86 of heat exchanger 10 described above, and can be incorporated into a heat exchanger core 12 and heat exchanger in the same manner as core plates 84, 86 described above.

Figure 28:
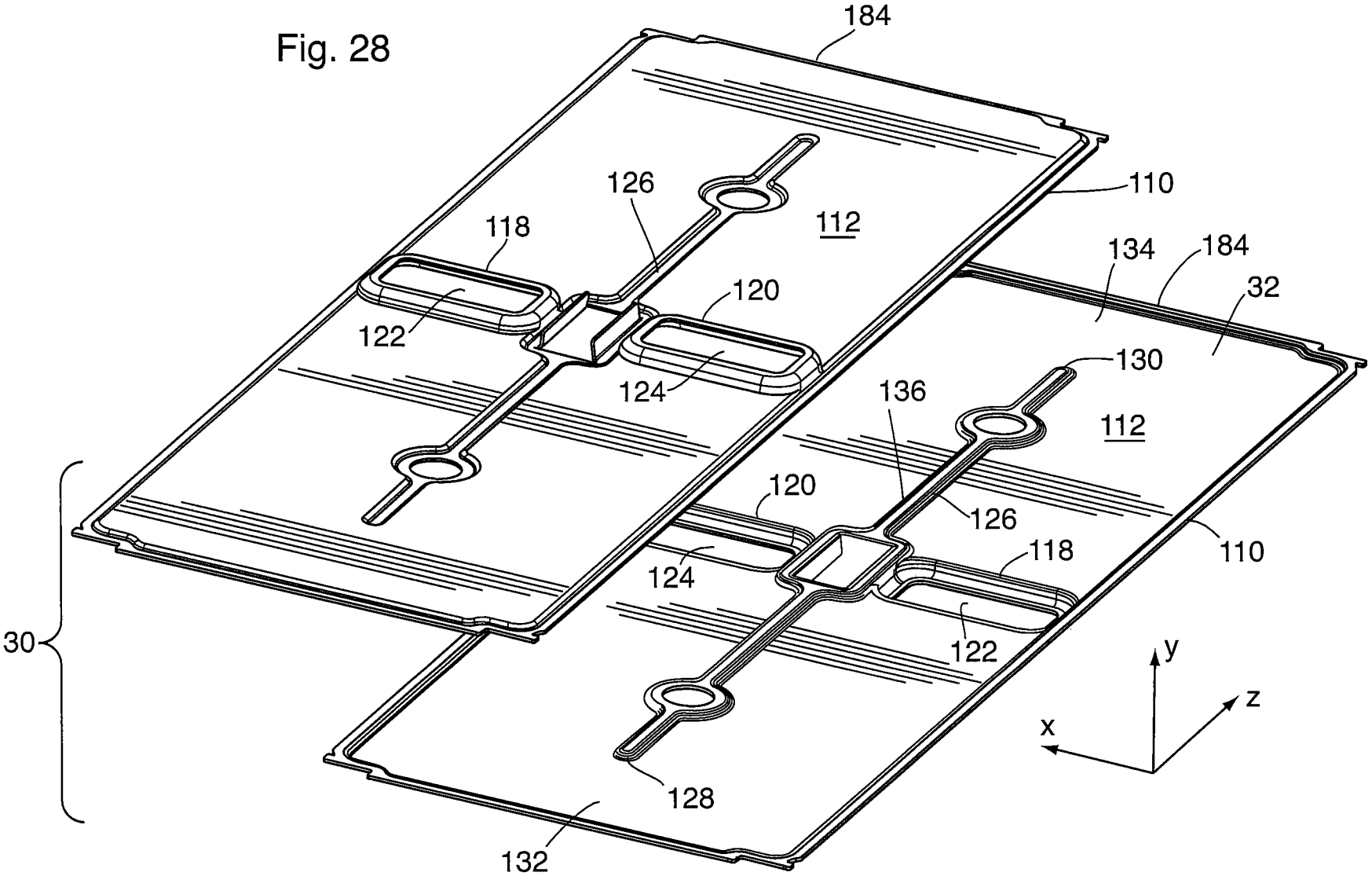
FIG. 28 is a top perspective view showing upper and lower core plates of a heat exchanger according to another alternate embodiment.
Figure 29:
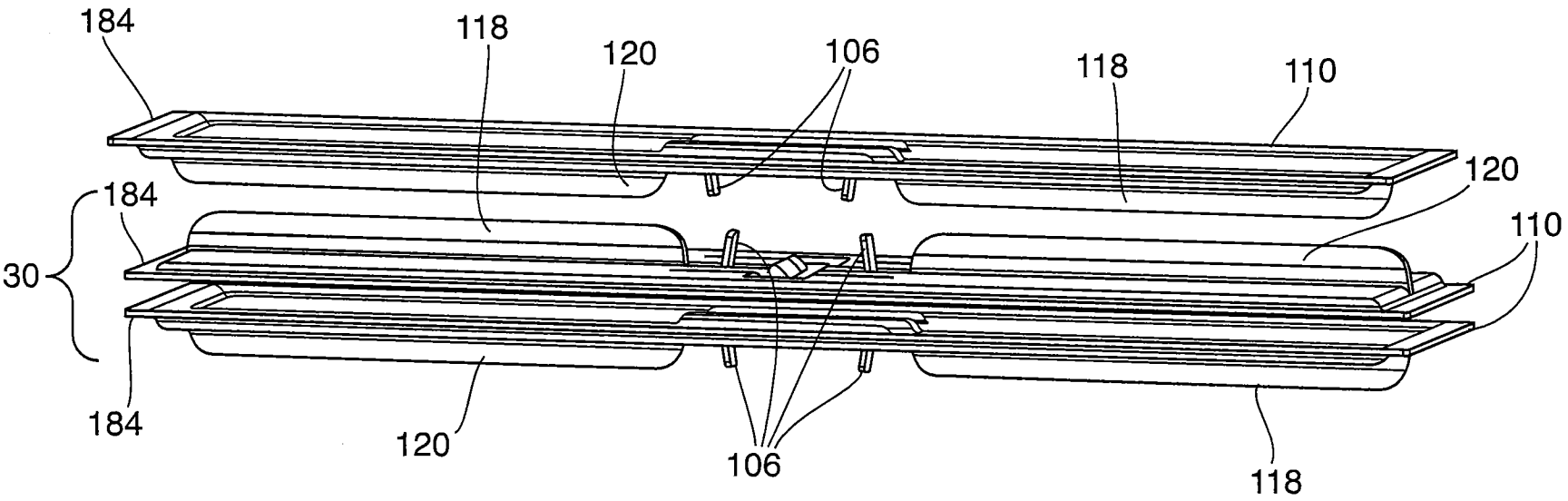
FIG. 29 is a side view showing three core plates of FIG. 28.

While the particular configuration of tubes 30 described above, having upstanding side edges, is advantageous as it provides core 12 with substantially flat sides 18, 20 and flat front and rear faces 22, 24, this configuration is not essential. In this regard, FIGS. 28 and 29 illustrate an alternate core plate 184 from which the core 12 of a heat exchanger can be constructed. This single core plate 184 can replace both types of core plates 84, 86 in the core 12 of heat exchanger 10.

FIG. 28 shows both a pair of identical mirror image core plates 184 used to form a tube 30 to be incorporated into the core 12 of a heat exchanger. In the following description, the numbering of the elements of core plate 86 and/or core plate 84 are used to describe like elements of core plate 184. Core plate 184 has a continuous peripheral flange 110 surrounding and extending away from a generally flat planar central portion 112 in a first vertical direction (y axis). The core plate 184 is provided with a pair of bosses 118, 120 aligned along the gas flow direction (x axis), and extending from central portion 112 in a second vertical direction which is opposite to the first vertical direction. The bosses 118, 120 are perforated to define respective coolant manifold openings 122, 124. The core plate 184 also has a flow separation rib 126 located between the bosses 118, 120 and extending from the central portion 112 in the first vertical direction, and having a flat sealing surface 136 which is coplanar with the flange 110. The flow separation rib 126 extends transversely along the z axis, having opposed terminal ends 128, 130 which are spaced from the peripheral flange 110 to define flow-through gaps 132, 134.

The sealing surface 136 of flow separation rib 126 includes a widened portion 138 between the bosses 118, 120, the widened portion 138 having a rectangular shape. The flaps 106 are formed by slitting the core plate 184 in the widened portion 138 for form the flaps 106, and then folding the flaps 106 toward the second vertical direction so that they project from the plate 184 in the same direction as the bosses 118, 120, with the result that a hole 108 is formed in the widened portion 138 between the flaps 106. The flaps 106 each have a length (along the z axis) similar to that of flap 106 described above, and a height (along the y axis) such that the free ends of the flaps 106 are substantially co-planar with the tops of the bosses 118, 120. The flaps 106 may be vertical (along the y axis) or may be inclined toward one another as shown in the drawings.

A tube 30 of a heat exchanger core 12 is formed by coupling together a pair of plates 184 in face-to-face arrangement (i.e. the orientation shown in FIG. 28) such that the peripheral flanges 110 of the two plates 184 sealingly engage one another, and such that the flat sealing surfaces 136 of the two plates 184 sealingly engage one another. In particular, the flaps 106 are formed such that a remaining area of the widened portion 138 provides a sealing surface which surrounds the hole 108, thereby sealing the fluid flow passageway 32 between the plates 184.

FIG. 29 shows three plates 184 in a stacked orientation. The core 12 is formed by stacking the tubes 30 on top of one another, separated by gas flow passages 34 provided with turbulence-enhancing inserts 36 as described above. In the assembled core, the aligned bosses 118, 120 will form coolant manifolds, such as manifolds 144, 146 described above. It can be seen from this drawing that the flaps 106 of opposed plates 184 in adjacent tubes 30 will face one another with their free ends in close proximity to each other, to effectively block the bypass channels between the bosses 118, 120 and the segments 148, 150 of the turbulence-enhancing inserts 36 to be placed in the gas flow passages 34, as shown and described in relation to the above embodiments.

A core 12 constructed from tubes 30 comprising core plates 184 is specifically adapted for enclosure in a housing, and may include bypass-blocking features between the core and housing, for example such as those described in commonly assigned U.S. provisional application No. 62/408,216 filed on Oct. 14, 2016, the contents of which are incorporated herein by reference in their entirety. In addition, where the core 12 includes uppermost and lowermost gas flow passages 34A, 34C as described above, a heat exchanger constructed using core plates 184 may include top and bottom blocking flanges 74, 76 as described in any of the above embodiments.

While certain embodiments of heat exchangers having aerodynamic features for improved performance have been described herein, it will be understood that certain adaptations and modifications of the described embodiments can be made. Therefore the embodiments described above are considered to be illustrative and not restrictive.

What is claimed is:

1. A gas-liquid heat exchanger comprising a heat exchanger core having a top, a bottom, a pair of sides, an open front face and an open rear face, wherein a gas flow direction is defined through the core from the front face to the rear face, the sides of the core extending parallel to the gas flow direction, and wherein the core has a height defined between its top and bottom;

wherein the core comprises:

a plurality of flat tubes stacked in parallel relation to one another, each of the flat tubes enclosing a liquid flow passage for circulation of a liquid coolant;

a plurality of gas flow passages, each of which is defined in a space between an adjacent pair of said flat tubes, wherein the gas flow passages are open at the front face and the rear face of the core, and wherein the gas flow passages are provided with turbulence-enhancing inserts;

wherein each of the flat tubes comprises a pair of core plates joined together at their peripheral edges to enclose and define a coolant flow passage;

each of the core plates including a pair of bosses defining coolant manifold openings, wherein the bosses are aligned throughout the height of the core to define coolant inlet and outlet manifolds, wherein the coolant inlet and outlet manifolds are aligned along the gas flow direction, spaced apart from one another along the gas flow direction, and spaced inwardly from the sides of the core; and wherein each of the turbulence-enhancing inserts has a first section with a first peripheral edge extending in the gas flow direction and located adjacent to a first side of the inlet and outlet manifolds, and a second section with a second peripheral edge extending in the gas flow direction and located adjacent to an opposite, second side of the inlet and outlet manifolds;

wherein at least one of the core plates in each of the flat tubes includes a flap projecting into one of the gas flow passages, and positioned to cover a gas bypass channel extending lengthwise from the front face to the rear face of the core and extending widthwise between the first peripheral edge of the first section of the turbulence-enhancing insert and the second peripheral edge of the second section of the turbulence-enhancing insert;

wherein the flap is provided in a space between the inlet and outlet manifolds, and extends transversely to the gas flow direction between the first peripheral edge of the first section of the turbulence-enhancing insert and the second peripheral edge of the second section of the turbulence-enhancing insert;

such that the flap is spaced inwardly from the sides of the core and spaced inwardly from the front and rear faces of the core.

2. The gas-liquid heat exchanger of claim 1, wherein the flap has a free end which engages or is in close proximity to a surface of an adjacent one of said flat tubes.

3. The gas-liquid heat exchanger of claim 1, wherein each said pair of core plates comprises a first core plate and a second core plate;

wherein the flap is formed in the first core plate, the first core plate further comprising a hole adjacent to the flap, the hole having a periphery with a size and shape corresponding to a size and shape of the flap;

wherein the second core plate includes a flow separation rib separating the bosses and extending transversely to the gas flow direction, wherein the flow separation rib has a sealing surface which is sealed to the first core plate;

wherein the flow separation rib has a widened portion located between the bosses, wherein the sealing surface has sufficient dimensions in the widened portion of the rib so as to surround and sealingly engage the periphery of the hole in the first core plate.

4. The gas-liquid heat exchanger of claim 3, wherein the widened portion of the flow separation rib includes a trough which is surrounded by the sealing surface, wherein the trough of one said plate pair is in close proximity to or in engagement with the flap of an adjacent one of said plate pairs.

5. The gas-liquid heat exchanger of claim 1, wherein:

both of the core plates of each said pair includes two of said flaps, each of the core plates further comprising a hole located adjacent to and between said two flaps, the hole having a periphery surrounded by a sealing surface;

wherein the sealing surface surrounding the hole of one said core plate seals to the sealing surface surrounding the hole of the other one of the core plates comprising said pair of plates.

6. The gas-liquid heat exchanger of claim 5, wherein the flaps each have a height which is substantially the same as a height of the bosses.

7. The gas-liquid heat exchanger of claim 5, wherein each of the core plates includes a flow separation rib separating the bosses and extending transversely to the gas flow direction, the flow separation rib having a sealing surface, wherein the sealing surface of the flow separation rib of one said core plate is sealed to the sealing surface of the flow separation rib of the other one of the core plates comprising said pair of plates.

8. The gas-liquid heat exchanger of claim 7, wherein the sealing surface surrounding the hole in each of the core plates is part of the sealing surface of the flow separation rib, and is provided in a widened portion of the flow separation rib located between the bosses.

* * * * *